US009909384B2

(12) United States Patent
Chauffe et al.

(10) Patent No.: US 9,909,384 B2
(45) Date of Patent: Mar. 6, 2018

(54) MULTI-ACTUATING PLUGGING DEVICE

(71) Applicant: TEAM OIL TOOLS, LP, The Woodlands, TX (US)

(72) Inventors: Stephen J. Chauffe, The Woodlands, TX (US); Edwin A. Eaton, Grapevine, TX (US); John P. Rodgers, Southlake, TX (US)

(73) Assignee: TEAM OIL TOOLS, LP, The Woodlands, TX (US)

( * ) Notice: Subject to any disclaimer, the term of this patent is extended or adjusted under 35 U.S.C. 154(b) by 304 days.

(21) Appl. No.: 14/686,613

(22) Filed: Apr. 14, 2015

(65) Prior Publication Data

US 2015/0218904 A1 Aug. 6, 2015

Related U.S. Application Data

(63) Continuation-in-part of application No. 13/408,026, filed on Feb. 29, 2012, now Pat. No. 9,004,179.

(60) Provisional application No. 61/448,346, filed on Mar. 2, 2011.

(51) Int. Cl.

| | |
|---|---|
| ***E21B 33/12*** | (2006.01) |
| ***E21B 34/14*** | (2006.01) |
| ***E21B 33/128*** | (2006.01) |
| ***E21B 33/129*** | (2006.01) |
| *E21B 34/00* | (2006.01) |

(52) U.S. Cl.

CPC ..... *E21B 33/128* (2013.01); *E21B 33/12* (2013.01); *E21B 33/129* (2013.01); *E21B 34/14* (2013.01); *E21B 2034/007* (2013.01)

(58) Field of Classification Search

CPC ..... E21B 33/12; E21B 33/128; E21B 33/129; E21B 34/14; E21B 47/09

See application file for complete search history.

(56) References Cited

U.S. PATENT DOCUMENTS 1,858,215 A * 5/1932 Baker ..... E21B 21/10 166/132
1,949,498 A 3/1934 Stone
2,200,505 A 5/1940 Kerr (Continued)

FOREIGN PATENT DOCUMENTS

WO 2012045165 A1 4/2012

OTHER PUBLICATIONS

Unknown Author, PCT Search Report dated Jun. 6, 2012, International Application No. PCT/US2012/027104, filed Feb. 29, 2012, pp. 1-13.

(Continued)

*Primary Examiner* — Jennifer H Gay

(74) *Attorney, Agent, or Firm* — MH2 Technology Law Group, LLP

(57) ABSTRACT

A plugging device, apparatus, and method. The plugging device includes an expandable member configured to move from a first, retracted position to a second, expanded position, a counter configured to count a number of restrictions in a conduit that the plugging device passes through, and an actuator configured to move the expandable member from the first position to the second position in response to the counter counting a predetermined number of restrictions. The expandable member in the expanded position prevents the plugging device from passing through a target restriction.

22 Claims, 33 Drawing Sheets

(56) References Cited

U.S. PATENT DOCUMENTS 3,263,752 A * 8/1966 Conrad ..... E21B 34/14 166/154
3,381,750 A * 5/1968 Brown ..... E21B 47/09 166/214
4,782,894 A 11/1988 Lafleur
4,969,515 A * 11/1990 Dollison ..... E21B 33/12 166/133
7,503,392 B2 3/2009 King
7,637,323 B2 12/2009 Schasteen et al.
8,403,068 B2 3/2013 Robison et al.
8,479,823 B2 7/2013 Mireles
8,607,811 B2 12/2013 Korkmaz
8,668,013 B2 3/2014 O'Connell et al.
9,004,179 B2 * 4/2015 Chauffe ..... E21B 34/06 166/250.04
9,650,851 B2 * 5/2017 Whitsitt ..... E21B 23/00
2009/0308588 A1 12/2009 Howell et al.
2010/0282338 A1 * 11/2010 Gerrard ..... E21B 33/1208 137/330
2010/0294515 A1 * 11/2010 Xu ..... E21B 23/006 166/386
2011/0067888 A1 3/2011 Mireles
2011/0127028 A1 * 6/2011 Strickland ..... E21B 33/12 166/55.1
2011/0240311 A1 * 10/2011 Robison ..... E21B 23/04 166/373
2012/0048556 A1 3/2012 O'Connell et al.
2012/0085538 A1 * 4/2012 Guerrero ..... E21B 33/12 166/284
2012/0085548 A1 4/2012 Fleckenstein et al.
2012/0186874 A1 * 7/2012 Malone ..... E21B 47/01 175/45
2013/0025871 A1 1/2013 O'Connell et al.
2013/0112436 A1 * 5/2013 Fleming ..... E21B 23/006 166/386
2013/0118732 A1 5/2013 Chauffe et al.
2013/0186633 A1 7/2013 Kitzman
2013/0206402 A1 8/2013 Coon
2013/0220603 A1 8/2013 Robison et al.
2013/0264049 A1 10/2013 Mireles
2013/0299199 A1 11/2013 Naedler et al.
2014/0076542 A1 3/2014 Whitsitt et al.
2015/0060064 A1 * 3/2015 Lafferty ..... E21B 34/14 166/280.1
2015/0152709 A1 * 6/2015 Tough ..... E21B 43/26 166/374
2015/0159469 A1 * 6/2015 Purkis ..... E21B 23/04 166/373
2015/0218904 A1 * 8/2015 Chauffe ..... E21B 33/128 166/250.01
2015/0361747 A1 * 12/2015 Lafferty ..... E21B 34/14 166/373
2015/0361761 A1 * 12/2015 Lafferty ..... E21B 23/14 166/250.01
2016/0032684 A1 * 2/2016 Shkurti ..... E21B 34/14 166/64
2016/0084075 A1 * 3/2016 Ingraham ..... E21B 23/10 166/255.1
2016/0108722 A1 * 4/2016 Whitsitt ..... E21B 34/14 166/254.1
2016/0258259 A1 * 9/2016 Walton ..... E21B 34/14
2016/0333665 A1 * 11/2016 Graf ..... E21B 34/14

OTHER PUBLICATIONS

Examination Report dated Sep. 27, 2017, GB Application No. GB1315326.7, pp. 1-2.

* cited by examiner

MULTI-ACTUATING PLUGGING DEVICE

CROSS-REFERENCE TO RELATED APPLICATIONS

This application is a continuation-in-part of U.S. patent application Ser. No. 13/408,026, which was filed on Feb. 29, 2012 and claims priority to U.S. Provisional Patent Application Ser. No. 61/448,346, filed on Mar. 2, 2011.

BACKGROUND

Fracturing is a process that results in the creation of fractures in rocks. The technique of fracturing (or "fracking") is used to increase or restore the rate at which fluids, such as oil, gas or water, can be produced from a reservoir, including unconventional reservoirs such as shale rock or coal beds. Fracturing may facilitate the production of natural gas and oil from rock formations deep below the Earth's surface (e.g., 5,000-20,000 feet or 1,500-6,100 m). At such depth, there may not be sufficient porosity and permeability to allow natural gas and oil to flow from the rock into the wellbore at economic rates. The fractures produced by fracking, however, provide a conductive path connecting a larger area of the reservoir to the well, thereby increasing the area from which natural gas or liquid can be recovered from the targeted formation.

Hydraulic fracturing may be conducted by pumping the fracturing fluid into the wellbore at a rate sufficient to increase the pressure within the well to a value in excess of the fracture gradient of the formation rock. The pressure causes the formation to crack, allowing the fracturing fluid to enter and extend the crack farther into the formation. Hydraulic fracture stimulation is commonly applied to wells drilled in low-permeability reservoirs.

The location of fracturing along the length of the wellbore may be controlled by stimulation valves positioned below and/or above the region to be fractured. This allows a wellbore to be progressively fractured along the length of the wellbore, sometimes referred to as "multi-stage fracking" Piping above the valves admits fracturing fluid and proppant into the working region, while the valves may prevent such fluid (and pressure) from communicating below the region to be fractured. These stimulation valves typically use ball seats and plug elements.

Generally, such ball seat valves have progressively smaller ball seats as proceeding farther into the wellbore from the surface. This allows selective actuation (sealing) of the stimulation valve by deploying progressively larger balls. The initially very small balls pass by the valves at the top, and are caught by the largest valve with a seat small enough to catch the ball. While this has been successfully implemented many times, the design calls for stimulation valves with many different sizes, which complicates the fracturing assembly. Other challenges also arise in such assemblies.

SUMMARY

Embodiments of the disclosure may provide a plugging device. The plugging device includes an expandable member configured to move from a first, retracted position to a second, expanded position, a counter configured to count a number of restrictions in a conduit that the plugging device passes through, and an actuator configured to move the expandable member from the first position to the second position in response to the counter counting a predetermined number of restrictions. The expandable member in the expanded position prevents the plugging device from passing through a target restriction.

Embodiments of the disclosure may also provide an apparatus for restricting flow through a conduit. The apparatus includes a plugging device configured to be dropped into the conduit, a counter for counting a number of restrictions through which the plugging device proceeds in the conduit, and a valve defining a plug seat to be disposed within the conduit to catch the plugging device when the number of restrictions counted by the counter meets or exceeds a predetermined number.

Embodiments of the disclosure may further provide a method for restricting flow in a wellbore deploying a plugging device into a conduit including a plurality of restrictions, the plurality of restrictions including a target restriction and at least one other restriction. When deployed, the plugging device encounters the at least one other restriction prior to the target restriction, and the at least one other restriction has a restriction diameter of a same or smaller size as a restriction diameter of the target restriction. The plugging device includes an expandable member configured to expand from a first, retracted position to a second, expanded position, a counter configured to count a number of restrictions that the plugging device passes through, and an actuator configured to expand the expandable member from the first position to the second position in response to the counter counting a predetermined number of restrictions. The expandable member in the expanded position prevents the plugging device from passing through the target restriction.

The above presents a simplified summary of the present disclosure in order to provide a basic understanding of some aspects thereof. This summary is thus not an exhaustive overview of the present disclosure and is not intended to identify key or critical elements thereof.

BRIEF DESCRIPTION OF THE DRAWINGS

The present disclosure may be understood by reference to the following description taken in conjunction with the accompanying drawings. In the drawings.

DETAILED DESCRIPTION

Figures 1A, 1B, 1C, 1D, 1E:
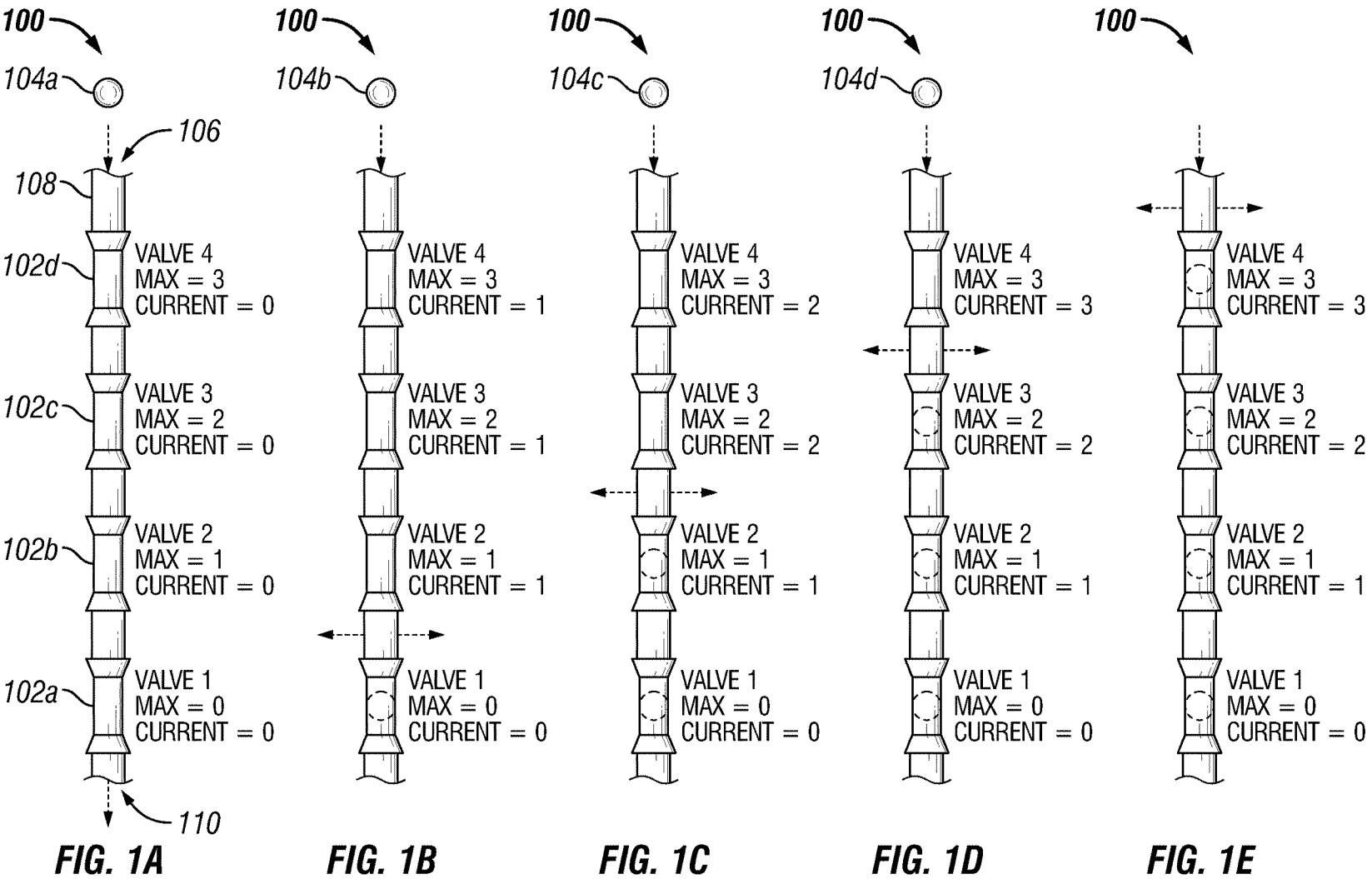
FIGS. 1A-1E illustrate five side, schematic views of a stimulation valve system, according to an embodiment.

Illustrative embodiments are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Further, although terms implying a direction, such as "up," "upper," "upward," "above," "down," "lower," "downward," "below," etc. may be employed herein, these terms are merely used to describe the relative positioning of elements and should not be considered to imply any particular frame of reference or, for example, orientation in a vertical, horizontal, or deviated well.

In general, embodiments of the present disclosure may provide a plugging device or "ball" that may be configured to count the number of restrictions (e.g., valve or ball seats) that it has passed through, and expand prior to reaching a targeted one of the restrictions, to seal or otherwise engage therewith. Such a plugging device may include a trigger, a counter, an actuator, and an expandable member.

The trigger may react to passing through a restriction. The trigger may be mechanical, such as a pivoting arm that moves by engagement with a restriction, or may be an electrical device or a magnetic, such that the trigger measurably reacts when plugging device passes through a restriction. Some triggers may be electrical, magnetic, and/or mechanical.

The counters may count the number of reactions by the trigger. The counter may be mechanical, using arms, gears, ratchets, pawls, etc. that may be incrementally adjusted with each pass of the trigger through a restriction, until the plugging device has passed through a certain number of restrictions. In other embodiments, the counter may be at least partially electrical, and may include wires and a processor (e.g., programmable logic controller) to count the number of times the trigger reacts to a restriction.

The actuator may actuate in response to the counter registering the predetermined number of restrictions. The actuator may be any type of device or assembly that expands the expandable member, so as to allow the plugging device to catch on a subsequent restriction. For example, the actuator may be a shaft that pivots or otherwise moves and eventually releases a spring-loaded mandrel. In another embodiment, the actuator may be a cutting device that severs a cable or another device that releases a cable, again releasing a spring-loaded mandrel. The actuator may also include a motor, so as to pivot a shaft to release a spring-loaded mandrel, or rotate a threaded shaft to move a nut. Other actuators may also be employed, with the foregoing being just a few examples.

The expandable members may be coupled with the actuator, and may be expandable by interaction therewith. The expandable members may, for example, be actuating dogs that are pivoted or otherwise extended outward when the spring-loaded mandrel is released. In other embodiments, such actuating dogs may be expanded by rotating cams of the actuator. These, of course, are just two embodiments, and any type of expandable members, expanded using any type of actuator, may be employed. The expandable members may or may not form a seal with the targeted restriction, and may prevent the plugging device from passing through the restriction. In some embodiments, a second one or set of expandable members may be employed to form the seal, with the first set being employed to catch the plugging device on the restriction.

As such, the plugging device may be configured to pass through any number of restrictions (e.g., ball seats, liner hangers, differently sized casing or tools, etc.) until reaching a target restriction, upon which the plugging device may land and seal. Accordingly, the restrictions encountered by the plugging device prior to the plugging device may have the same or even a smaller restriction diameter than the target restriction.

Embodiments of the present disclosure may also provide a valve that is configured to count the number of balls dropped therethrough. It will be appreciated that such counting balls and counting ball seats may be employed together or separately. When employed separately, the counting balls might be used with non-counting ball seats, and the counting ball seats may be employed with non-counting balls.

In an embodiment, the valve may include a housing, an outwardly expanding seat, and a ratcheting or indexing mechanism or equivalent electronic system. Each outwardly expanding ball seat may ratchet or cycle the valve as each ball drops past that ball seat. A ball may land on a ball seat where the conduit is pressurized to a predetermined pressure. Upon pressurization of the conduit, the ball may be pushed into or onto the seat which may cause the seat to expand outwardly, thus allowing the plug element (e.g., ball) to pass therethrough. The seat then retracts to the original contracted position (e.g., to catch a subsequent ball drop).

Expanding the seat outward may cause the internal gears/mechanisms to ratchet/index, cycle, and/or trigger (mechanically and/or electronically) the valve. The number of ratchets and/or cycles of the ball seat may be predetermined and upon the final cycle or ratchet, the ball seat may not allow the ball to pass. This may result in a subsequent ball resting in or on the ball seat and acting as a plugging device, even under increased pressure.

When the valve is plugged, applied pressure may activate one or more tools associated with this specific ball seat. For example, applied pressure may cause one or more ports to open in the wellbore in a region adjacent the ball seat (acting as a valve) to allow fluid, e.g., fracking fluid, to exit the well bore through the ports and into the adjacent strata. The act of indexing, ratcheting, or cycling may also be induced by a downward or lateral movement of the seat prior to the seat expanding outwardly.

Turning now to the illustrated embodiments, FIGS. 1A-E depict schematic views of a stimulation valve system 100, according to an embodiment. The stimulation valve system 100 may avoid pipe diameter reduction experienced in systems that rely on multiple ball sizes. In an embodiment, the stimulation valve system 100 may employ a single size ball 104 and ball-actuated stimulation valves 102. For example, valve 102*a* may be at one end of a conduit 108 (e.g., the bottom 110) followed by valve 102*b*, valve 102*c*, valve 102*d*, etc., until the desired number valves has been reached, or the opening 106 is reached. In some embodiments, one, some, or all of the stimulation valves 102 may be able to track the number of balls that have passed therethrough (e.g., using a mechanical ratcheting or gear type system and/or or an electronic sensor).

Once a pre-set number of passing balls has been reached, the individual stimulation valves 102 may constrict in diameter, be prevented from expanding to allow the ball to pass, or otherwise be configured to catch the next ball 104. Catching the ball 104 may allow the valve 102, or another tool, to be actuated, e.g., by application of pressure, so as to divert the pressure through openings in the wellbore (which may be opened by the ball landing on the respective seat) to fracture the well. Embodiments may be used in both open-hole and cased-hole scenarios. Although FIG. 1 illustrates a system wherein the ratcheting/cycling mechanism is integrated with the stimulation valves, it should be recognized that the ratcheting/cycling mechanism may be integrated with a plugging device or drop ball and used in conjunction with a standard ball seat.

Referring specifically to FIG. 1A, a conduit 108 is shown with four stimulation valves 102 in the open position. Although four stimulation valves 102 are used in the following examples, any number may be employed. Prior to dropping the first ball 104*a*, a fluid is able to pass straight through the pipe as indicated by the hashed arrows.

Each stimulation valve 102 may have a pre-set max ball value (denoted in FIGS. 1A-E as "Max=x") and a current ball count value (denoted in FIGS. 1A-E as "Current=y" and initially set to equal 0) configured such that when the current ball count value is equal to the pre-set max ball value, the next ball 104 dropped is "caught" by the stimulation valve 102, thus closing off the valve 102 and opening the sleeve at that level for well fracturing. For the following example, valve 102*a* has a max value of 0, valve 102*b* has a max value of 1, valve 102*c* has a max value of 2, and valve 102*d* has a max value of 3. Since valve 102*a* has a pre-set max ball value and current ball count value both equal to 0, valve 102*a* is configured to catch the first ball 104*a* dropped in this example.

Referring now to FIG. 1B, as the first ball 104*a* fell through the preceding valves (valve 102*b*, valve 102*c*, and valve 102*d*), each preceding valve ratcheted, or cycled, such that the current ball count value thereof was incremented by 1. In FIG. 1B, the first ball 104*a* dropped has landed on the valve seat of valve 1 (valve 102*a*), thereby blocking valve 102*a* and diverting the fluid to fracture the well (as indicated by the hashed arrow). Since valve 102*b* now has a pre-set max ball value and current ball count value both equal to 1, valve 102*b* is configured to catch the second ball 104*b* dropped.

Referring now to FIG. 1C, as the second ball 104*b* fell through the preceding valves (valve 102*c* and valve 102*d*), each preceding valve ratcheted, or cycled, such that the current ball count value thereof was incremented by 1. In the illustrated state, the second ball 104*b* dropped has landed on the valve seat, thereby blocking valve 102*b* and allowing the fluid to be diverted outward into the formation (as indicated by the hashed arrow). Since valve 102*c* now has a pre-set max ball value and current ball count value both equal to 2, valve 102*c* is configured to catch the third ball 104*c* dropped.

Referring now to FIG. 1D, as the third ball 104*c* fell through the preceding valve (valve 102*d*), the preceding valve ratcheted, or cycled, such that the current ball count value of valve 102*d* was incremented by 1. The third ball 104*c* landed on the valve seat, thereby blocking valve 102*c* and diverting the fluid outward into the formation (as indicated by the hashed arrow). Since valve 102*d* now has a pre-set max ball value and current ball count value both equal to 3, valve 102*d* is configured to catch the fourth ball 104*d* dropped.

Referring now to FIG. 1E, the fourth ball 104*d* has landed on the valve seat of valve 102*d*, thereby blocking valve 102*d* and allowing fluid to be diverted outward, into the formation (as indicated by the hashed arrow). Depending on the number of stimulation valves 102 installed in a conduit 108, this process may continue for any number of cycles until each stimulation valve 102 catches a ball.

There are a number of methods and ratcheting mechanisms for incrementing and/or ratcheting the stimulation valves 102. For example, a mechanical ratcheting, or cycling, system may operate such that when a ball lands in the valve seat, applied pressure (e.g., a pressure from the conduit's open end that pushes the ball) moves the valve seat down a notch and releases the ball (e.g., the seat expands outwardly causing the ball to pass). The ratcheting process may continue until the pre-set number of cycles has been completed, thus configuring the seat to catch the ball (e.g., the seat does not expand outwardly) allowing for the sleeve to open for fracturing at the desired level and diverting fluid, e.g., fracturing fluid, to fracture a well.

In another embodiment, a gear system may be employed and would work in a similar manner. For example, a passing ball may trip the gear until a pre-set number of cycles have been completed, whereupon the seat may move inwardly thus catching the next ball allowing for the sleeve to open and diverting a fluid force to fracture a well.

A rolling ball seat is yet another possible embodiment for ratcheting, incrementing or progressing the gears in the valve. For example, as the ball passes through the seat, the ball makes contact with rolling segments (that may act like a ball seat) and rotates the segments as the ball passes. The process repeats until the pre-set number of cycles has been completed, thus catching the ball (e.g., the rolling ball seat rolls into a catching configuration) allowing for the sleeve to open and diverting a fluid force to fracture a well.

Another possibility is that a segmented ball seat expands to expel the ball, then relaxes again ready to catch the next ball. The process repeats until the pre-set number of cycles has been completed, thus catching the ball (e.g., the seat remains locked in the relaxed position), allowing for the sleeve to open and diverting a force to fracture a well. For example, as discussed in greater detail below, a timed gear with a pre-set timing may be used where each time the ball seat cycles, it moves to the next position.

Yet another possibility is a configuration where the ball or plug may land in a collet-type seat. Downward motion cycles the gear and places the seat in a larger cavity allowing the collet fingers to expand, thus expelling the ball. The inherent spring force of the collet puts the seat back in the original position once the seat has cycled. The seat may be segmented to move either downward or outward to cycle the seat and expel the ball.

In some embodiments, the ratcheting and/or cycling mechanism may be located in the plugging device, e.g., such that shouldering dogs or trigger arms of the plugging device retract inwardly and thereby cycle the mechanism. For example, as the plugging device lands on the ball seat, applied pressure may cause the shouldering dogs and/or trigger arms retract inwardly allowing the plugging device to pass through the ball seat. The retracting process of the shouldering dogs or trigger arms cycles the plugging device. This process may repeat itself until the pre-set number of cycles has occurred at which point the shouldering dogs will no longer retract. The plugging device then acts as a conventional plugging device and is enabled to land and seat on the next ball seat.

Additionally or instead of mechanical ratcheting and/or cycling devices, an electronic system may be used to track the ball drops and/or control the ball seat. Electronic systems may also allow for a user to selectively control the valves using certain ball drops containing embedded information. For example, photoelectric sensors may be used to sense the passing of a ball drop to determine if and when a ball seat should be expanded to release or enabled to catch the ball drop. A photoelectric sensor, or photoeye, is a device often used to detect the distance, absence or presence of an object by using a light transmitter, often infrared, and a photoelectric receiver. Photoelectric sensors are available in a number of arrangements, including, for example, (i) opposed (a.k.a. through beam), (ii) retroreflective and (iii) proximity-sensing (a.k.a. diffused). This system may be accomplished using, for example, a laser sensor that emits a beam of light from its transmitter and a reflective-type photoelectric sensor to detect the light beam reflected from the target. The through-beam type is used to measure the change in light quantity caused by the target crossing the beam.

In some embodiments, the sensor (e.g., photoelectric sensors, radio-frequency identification ("RFID") readers, etc.) may be positioned before the ball valve, allowing the ball seat to respond (e.g., expand or retract) in time to catch a particular ball drop. For example, referring to FIGS. 2A-2D, there is depicted a conduit 208 with four ball valves 202*a-d* in the open position. Each ball valve 202*a-d* has a ball identification number (denoted in FIGS. 2A-D as "Ball ID=w") that corresponds to an identification number associated with a particular ball. The system is configured such that, when data from an RFID tag identifier of a ball matches the ball identification number of one of the valves 202*a-d*, the one of the valves 202*a-d* catches the ball drop with the matching ball identification thus closing off the valve and opening the sleeve to fracture the well in a specific zone. Although only four ball valves 202*a-d* are used in this example, any number may be used.

As in the previous example, prior to dropping the first ball 204, a fluid is able to pass through the conduit 208, as indicated by the dashed arrows. However, in this embodiment, the user may choose to selectively close one of the valve 202*a-d*, using a particular ball 204*a*, 204*c*. To accomplish this, balls 204*a*, 204*c* may contain RFID tags (e.g., a passive RFID tag that may not require a power source in or on the ball 204*a*, 204*c*) containing data or other information capable of triggering a sensor. To read the embedded RFID tag, one or more RFID readers 212*a-d* may be positioned before the ball valve 202*a-d*, respectively. The RFID readers 212*a-d* may provide an electromagnetic field to initiate a signal transmission from the RFID tag of the ball 204*a*, 204*b*.

Figure 2A:
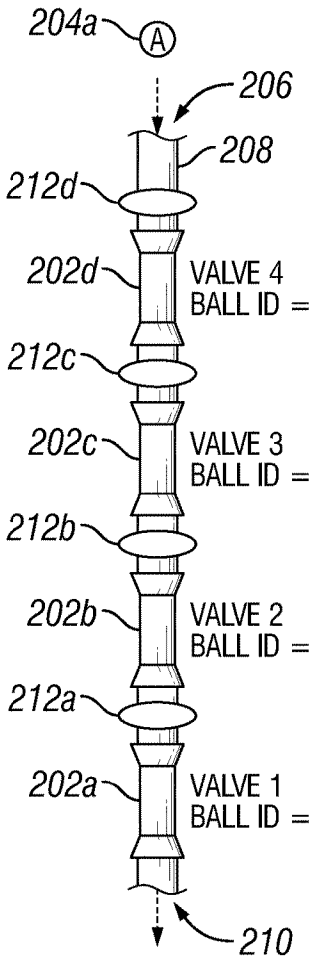
FIGS. 2A-D illustrate four side, schematic views of a stimulation valve system that includes selectable ball valves, according to an embodiment.
Figure 2B:
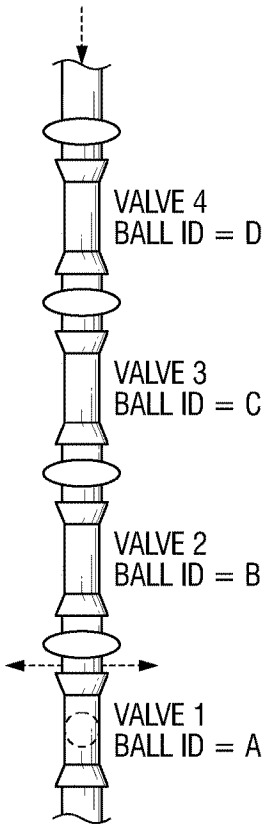

For example, referring now to the system shown in FIG. 2A, a user may choose to close valve 202*a*. To do so, the user may select the ball 204*a* with the corresponding ball identification number A. As ball 204*a* travels down conduit 208, RFID reader 212*a* may read the RFID tag thereof and close valve 202*a*. As seen in FIG. 2B, ball 204*a* may land on the valve seat of the valve 202*a*, thereby blocking valve 202*a* and permitting the fluid to be diverted outwards toward the formation (as indicated by the dashed arrow).

Figure 2C:
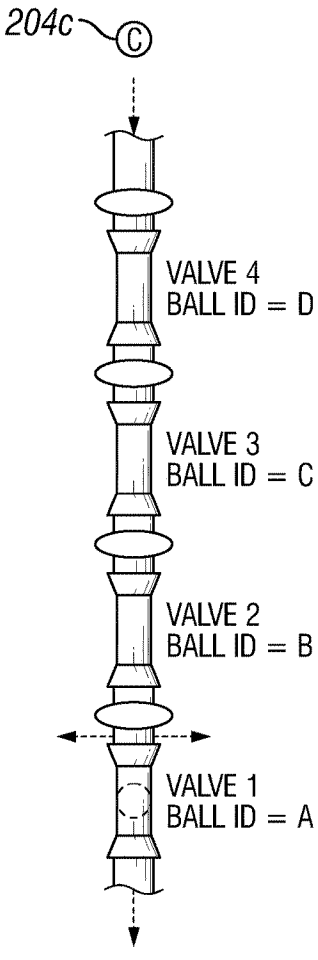
Figure 2D:
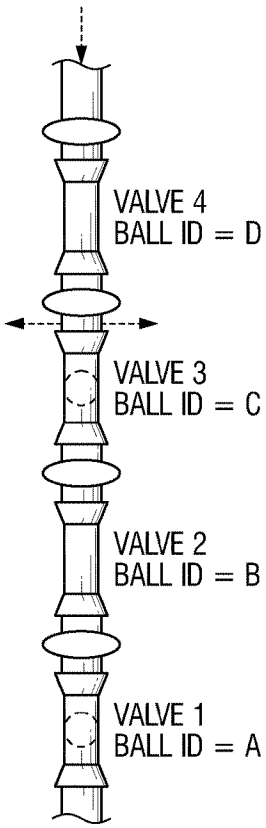

Referring now to the example in FIG. 2C, the user may wish to leave valve 202*b* open, but, close valve 202*c*. To do so, the user may select the ball 204*c* with the corresponding ball identification number C. As ball 204*c* travels down the conduit 208, the RFID reader 212*c* may read the RFID tag of the ball 204*c*, and, in response, close the valve 202*c*. As seen in FIG. 2D, the ball 204*c* may land on the valve seat of the valve 202*c*, blocking the valve 202*c* and diverting the fluid outward into the formation (as indicated by the dashed arrow).

Additionally or instead of having multiple RFID readers 212 installed along the conduit 208, a single RFID readers 212 may be installed at the opening 206 of the conduit 208, to read each ball as it is being dropped in the conduit 208. As such, the RFID data of the ball may be communicated to one or more valves, and the selected valve (chosen by selecting a particular ball) may be configured to catch the balls 204*a-d*. Furthermore, the valves and/or balls may use a variety of electric components to control valve and seat movement, including, for example, electric actuators, step motors, piezoelectric elements, and solenoids.

In certain embodiments, the sensor (e.g., photoelectric sensors, RFID reader, etc.) may trigger the plugging device's shouldering dogs to expand and thus land on the next ball seat.

Figure 3:
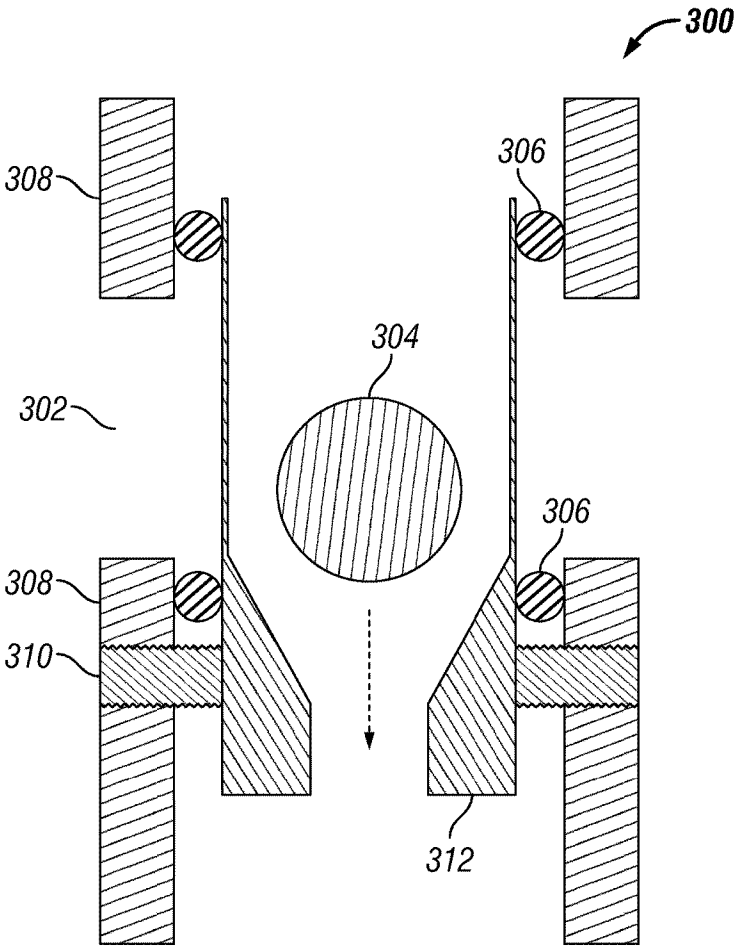
FIG. 3 illustrates a cross-sectional view of a ball-activated stimulation valve, according to an embodiment.

FIG. 3 illustrates a cross-sectional view of a ball-activated stimulation valve 300, according to an embodiment. The valve 300 is shown installed on a conduit 308. The valve 300 may include one or more O-rings 306, a seat 312, and one or more shear screws 310 for adjusting the shear pressure of the seat 312. Once a plugging device 304 deployed into the conduit 208 has landed on the seat 312, the valve 300 is sealed and the ball seat is sheared down exposing the flow port 302. Additional fluid may then be diverted through the flow port 302.

Figure 4:
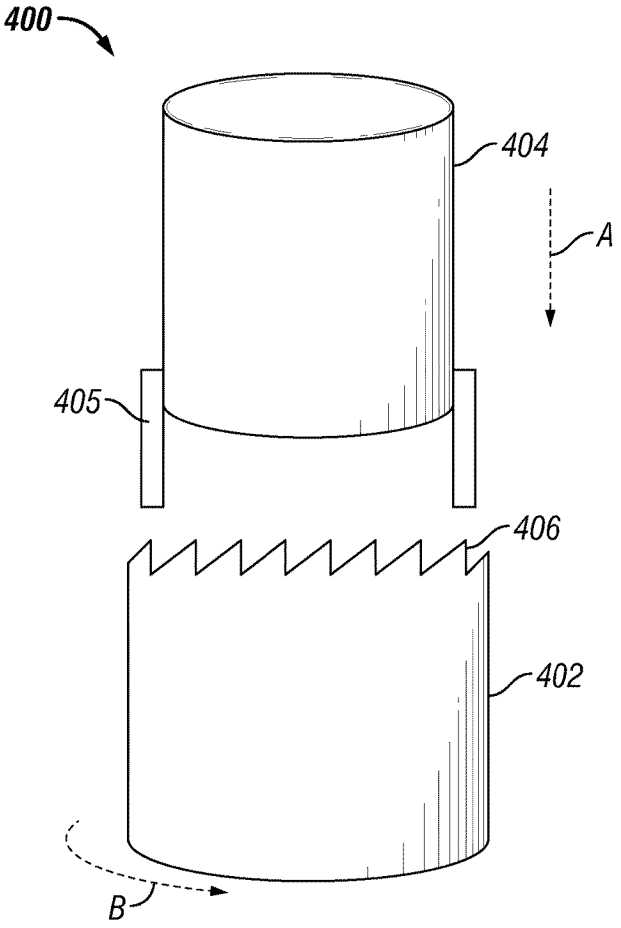
FIG. 4 illustrates a perspective view of a cylindrical ratcheting/indexing mechanism, e.g., for use in the ball-activated stimulation valve, according to an embodiment.

FIG. 4 illustrates a perspective view of a cylindrical ratcheting mechanism 400, according to an embodiment. A downward motion A of a tube 404 with a pawl 405 rotates, or cycles, a barrel 402, acting as a ratchet gear, in direction B, but may also be designed to rotate in the opposite direction of direction B. Once the predetermined number of cycles has occurred, rotation B and/or downward motion A may be prevented, thus preventing the ball seat from expanding. To set the number of cycles, a tooth 406 on the barrel 402 may be ground to form a 90° angle such that the mating tooth cannot proceed to the next gear. For example, if the user wishes to set the gear for four cycles, the 4th tooth 406 from the starting tooth 406 may be ground to form a 90° angle prohibiting the gear from progressing to the next tooth 406.

An embodiment of the cylindrical ratcheting mechanism 400 may use one or more springs (e.g., a compression spring). For example, one spring may be situated below the bottom half of the barrel 402. On the opposite side of the barrel 402, another spring may be located within the upper half of the tube 404. When the tube 404 is depressed, it relays pressure to the spring located within the upper half of the tube 404 where there are minute pits and teeth which intertwine with each other (a locking mechanism) to rotate and track the barrel 402 and expand the seat, thereby releasing the plug before retracting the seat and returning to a locked position.

Such a cylindrical ratcheting mechanism 400 may be housed within the body of the stimulation ball valve so that the downward or outward motion of the ball seat would induce the cycling and/or ratcheting motion. Such a cylindrical ratcheting mechanism 400 may also be housed within the body of the plugging device such that any downward or inward motion of the shouldering dogs 704 (see FIGS. 7A and 7B, discussed below) may induce the cycling and/or ratcheting motion.

Figure 5B:
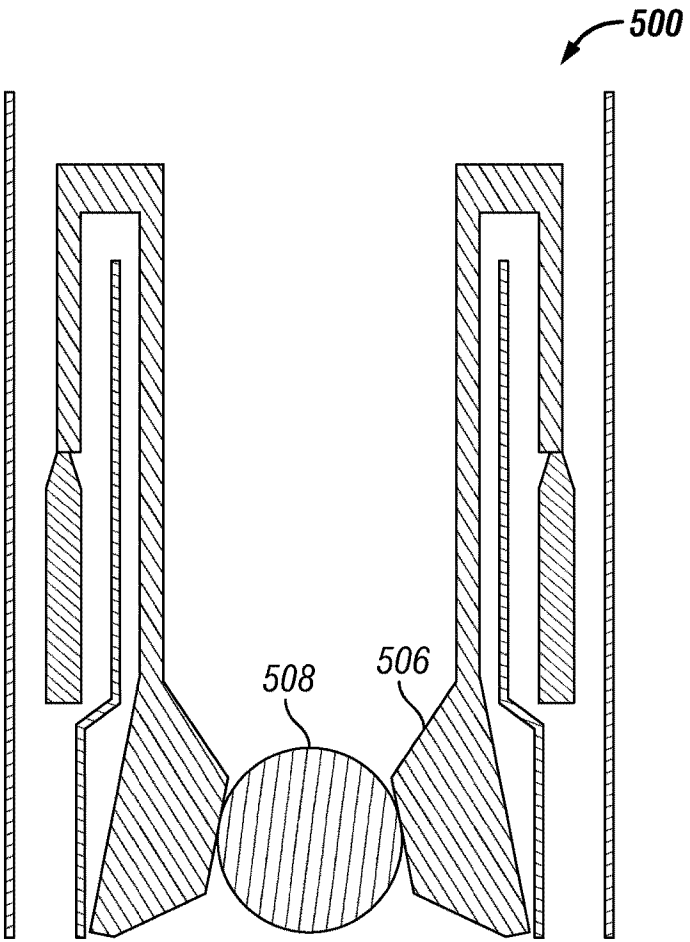
FIG. 5B illustrates a cross-sectional view of a cylindrical ratcheting/indexing mechanism integrated with a ball-activated stimulation valve, showing a ball being passed through the valve, according to an embodiment.
Figure 5A:
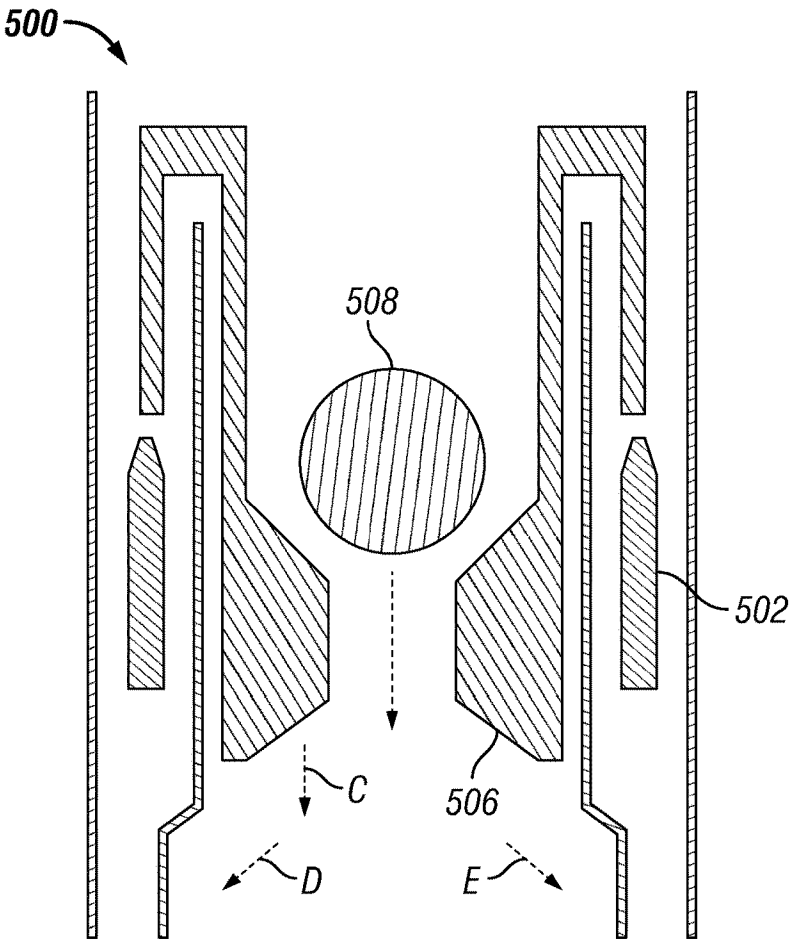
FIG. 5A illustrates a cross-sectional view of a cylindrical ratcheting/indexing mechanism integrated with a ball-activated stimulation valve, according to an embodiment.

FIGS. 5A-5E illustrate side, cross-sectional views of a cylindrical ratcheting mechanism 502 integrated with a ball-activated stimulation valve 500, according to an embodiment. In particular, FIG. 5A illustrates an outwardly expanding ball seat 506 that actuates a gearing or ratcheting mechanism having a predetermined number of cycles. Once all the cycles have occurred, the ball seat can no longer expand and thus functions as a standard ball seat, trapping the plugging device.

Referring now to FIG. 5B, as the ball 508 pushes the ball seat 506 downwardly in direction C, the cylindrical ratcheting mechanism 502 ratchets, or cycles, causing the ball seat 506 to move outwardly in directions D and E (see FIG. 5A), thereby releasing the ball 504. This process may cycle for a predetermined number of cycles as set by the gearing. For example, a notch (e.g., 90° tooth) may be carved into the ratcheting gear thereby preventing ratcheting after a predetermined number of cycles have been performed.

Figure 5C:
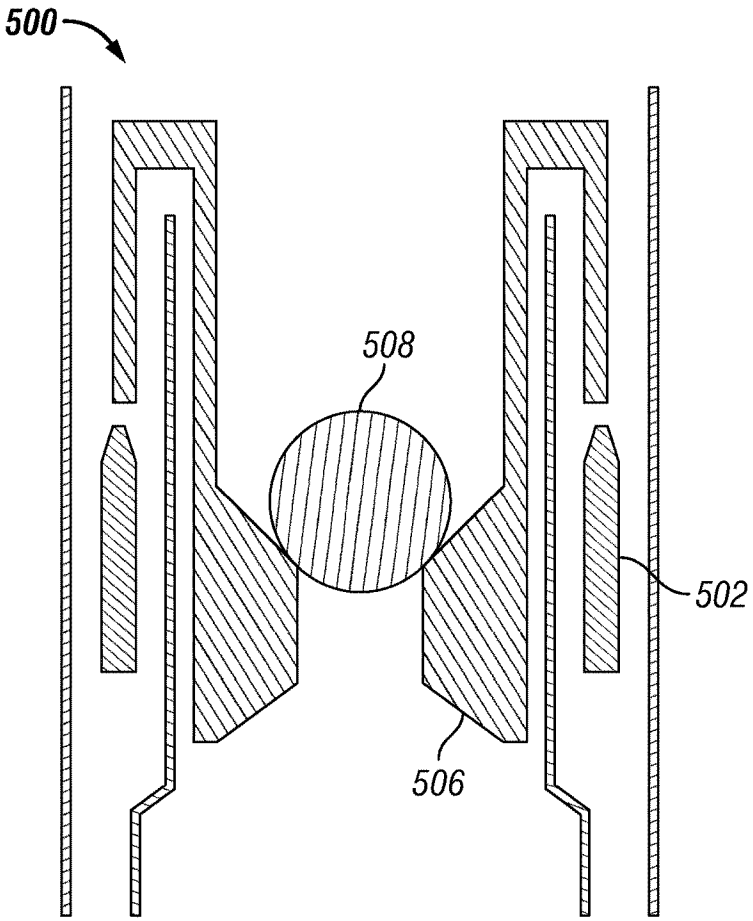
FIG. 5C illustrates a cross-sectional view of a cylindrical ratcheting/indexing mechanism integrated with a cycled ball-activated stimulation valve, showing a ball sealing the valve, according to an embodiment.
Figure 5E:
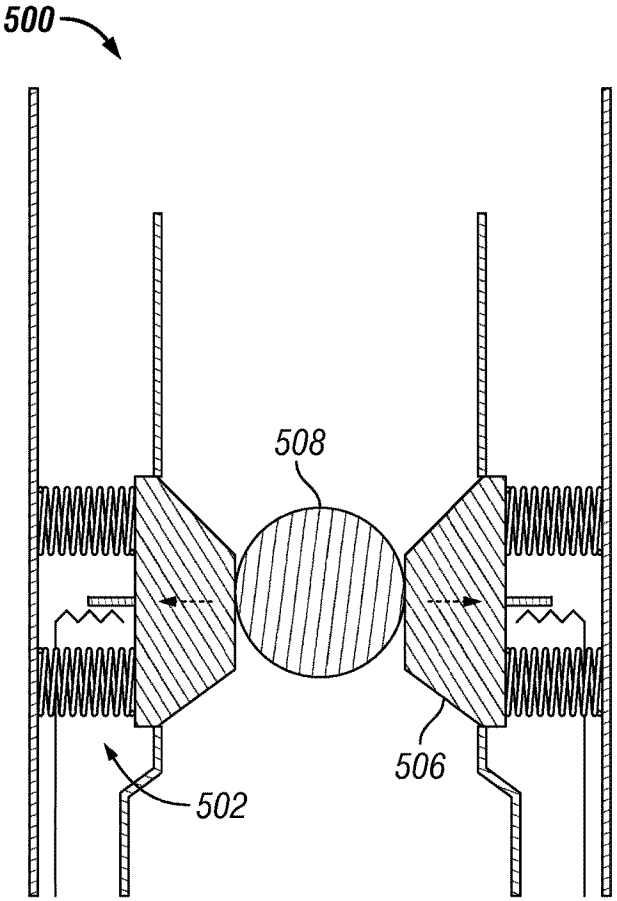
FIG. 5E illustrates a cross-sectional view of a cylindrical ratcheting/indexing mechanism integrated with a ball-activated stimulation valve, showing a ball being passed through the valve, according to an embodiment.
Figure 5D:
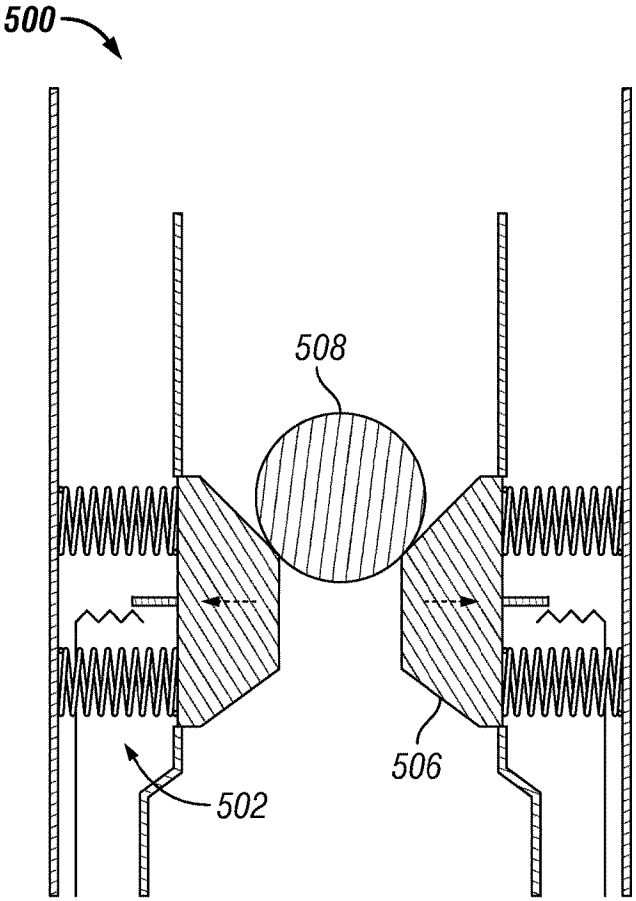
FIG. 5D illustrates a cross-sectional view of a cylindrical ratcheting/indexing mechanism integrated with a ball-activated stimulation valve, according to an embodiment.

Referring now to FIG. 5C, once the predetermined number of cycles has been met, the ball seat 506 may be locked in place, thereby catching the next ball 508 and plugging the ball valve system 500 and diverting the fluid to fracture the well. Other gearing mechanisms or electronic devices, such as those mentioned above, may be used in place of or in addition to the cylindrical ratcheting mechanism 502. With respect to FIGS. 5D and 5E, the seat may move outwardly to both ratchet the valve and release the ball. Other gearing mechanisms or electronic equivalents as are well known in the art may be used in place of cylindrical ratcheting mechanism 502.

Figure 7:
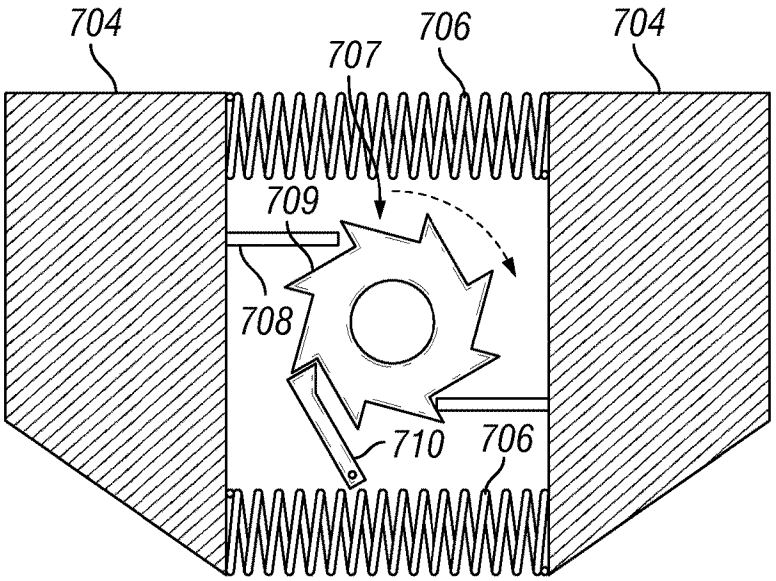
FIG. 7 illustrates an enlarged view of the gear or ratchet system of FIG. 6, according to an embodiment.
Figure 6:
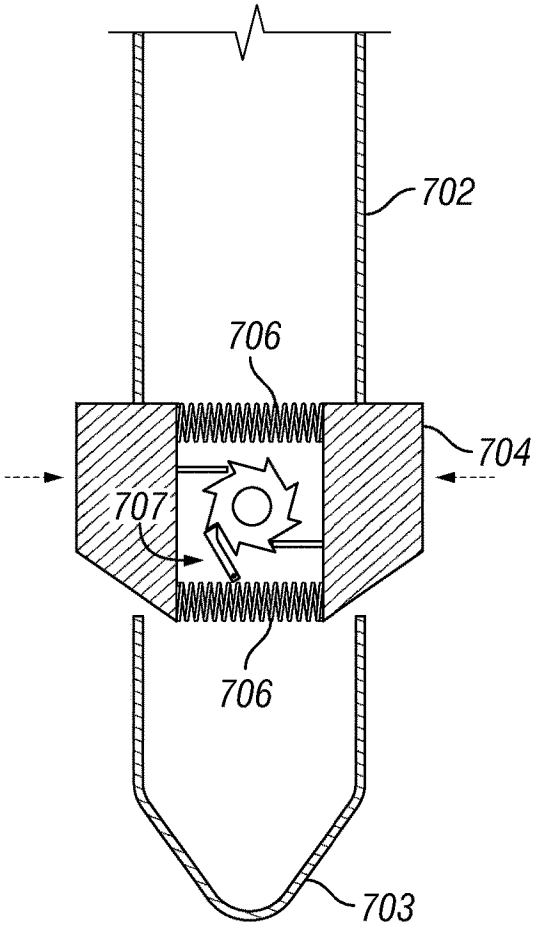
FIG. 6 illustrates a side, cross-sectional view of a plugging device with collapsible shouldering dogs and containing a gear or ratchet system, according to an embodiment.

FIGS. 6 and 7 illustrate cross-sectional views of a plugging device 702 (e.g., a pump-down plug) containing an internal gear or ratchet system 707, according to an embodiment. One or more shouldering dogs 704 may protrude from the sides of the plugging device 702. The shouldering dogs 704 may be spring loaded, e.g., via two springs 706, which may bias the shouldering dogs 704 apart, and thus radially outwards. Further, each dog 704 may be coupled with a pawl 708, which may extend inwards and into engagement with a ratchet gear 709, such that movement of the dogs 704 radially inward causes the ratchet gear 709 to rotate. In addition, the plugging device 702 may include a nose 703 on the lower side thereof.

In operation, the plugging device 702 may travel nose 703 first down a conduit. In one example, and not by way of limitation, as the plugging device 702 passes ball valve seats, the shouldering dogs 704 contract inwardly, which allows the plugging device 702 to continue down the conduit. Each time the plugging device 702 passes a ball valve seat, the internal ratcheting system 707 may cycle, as the pawls 708 of the shouldering dogs 704 cause the ratchet gear 709 to rotate as indicated by the dashed arrow. This may repeat until the pre-set maximum number of cycles is met.

Once the maximum number of cycles is met, the shouldering dogs 704 may be unable to retract and thus the plugging device 702 may land on the next ball valve seat. One or more additional pawls 710 may be used to lock the ratchet gear 709 in place to prevent rotation. Although a ratchet gear 709 is depicted in the example shown in FIGS. 6 and 7, other gearing mechanisms or electrical devices may be used.

Figure 8B:
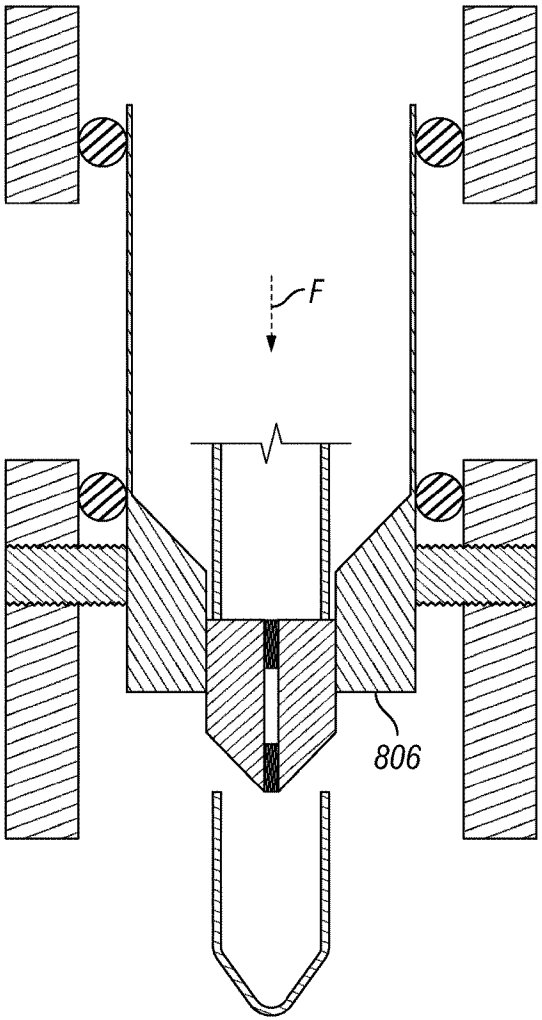
FIG. 8B illustrates a side, cross-sectional view of the plugging device of FIG. 8A landed on a ball seat, showing the plugging device is being passed through the valve, according to an embodiment.
Figure 8A:
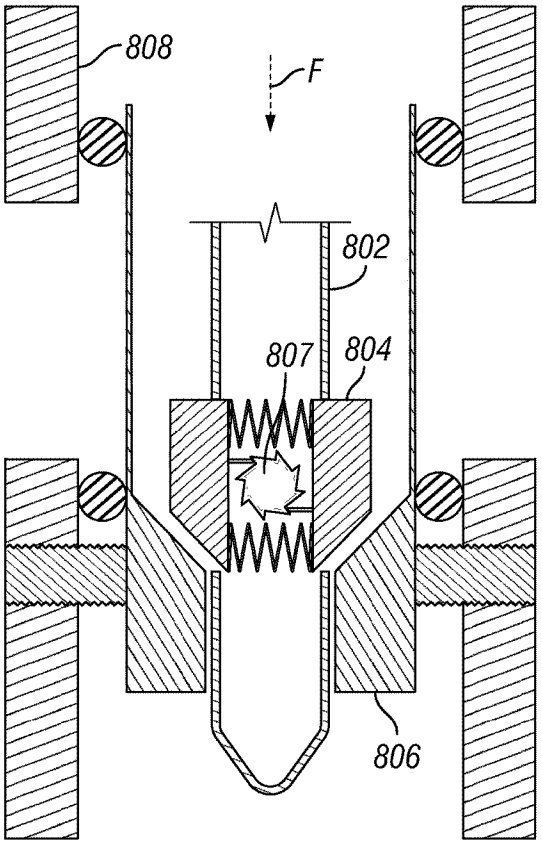
FIG. 8A illustrates a side, cross-sectional view of a plugging device with collapsible shouldering dogs that includes a gear or ratchet system, showing the device landed on a ball seat, according to an embodiment.
Figure 8C:
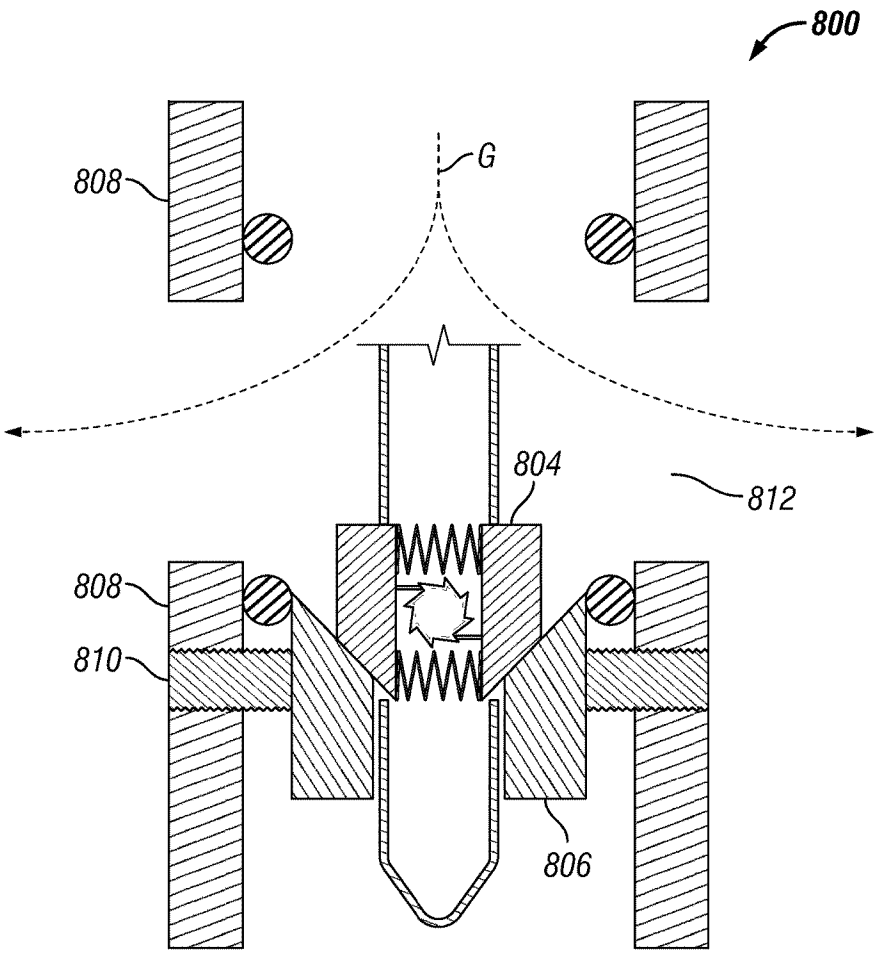
FIG. 8C illustrates a side, cross-sectional view of the plugging device landed on a ball seat and blocking fluid flow therethrough, according to an embodiment.

FIGS. 8A-8C illustrate cross-sectional views of a plugging device 802 containing a gear or ratchet system 807 in operation, according to an embodiment. As the plugging device 802 travels down conduit 808 in direction F, as shown in FIG. 8A, the plugging device 802 may encounter a valve seat 806. As shown in FIG. 8B, this may cause the shoulder dogs 804 to contract, so as to pass through the restriction provided by the valve seat 806. Such contraction may cause the internal gear or ratchet system 807 to cycle, as explained above. This process may cycle for a predetermined number of cycles as set by the gearing.

Referring now to FIG. 8C, once the predetermined number of cycles has been met, the shouldering dogs 804 may be locked in place causing the plugging device 802 to be landed on the valve seat 806, thereby plugging the valve system 800 and diverting the fluid G through flow port 812 to fracture the well. The valve seat 806 shear pressure may be adjusted using one or more shear screws 810. Although a ratchet gear is depicted in the example shown in FIGS. 8A-8C, other gearing mechanisms or electrical equivalents as are well known in the art may be used in place of ratchet system 807.

Figure 9A:
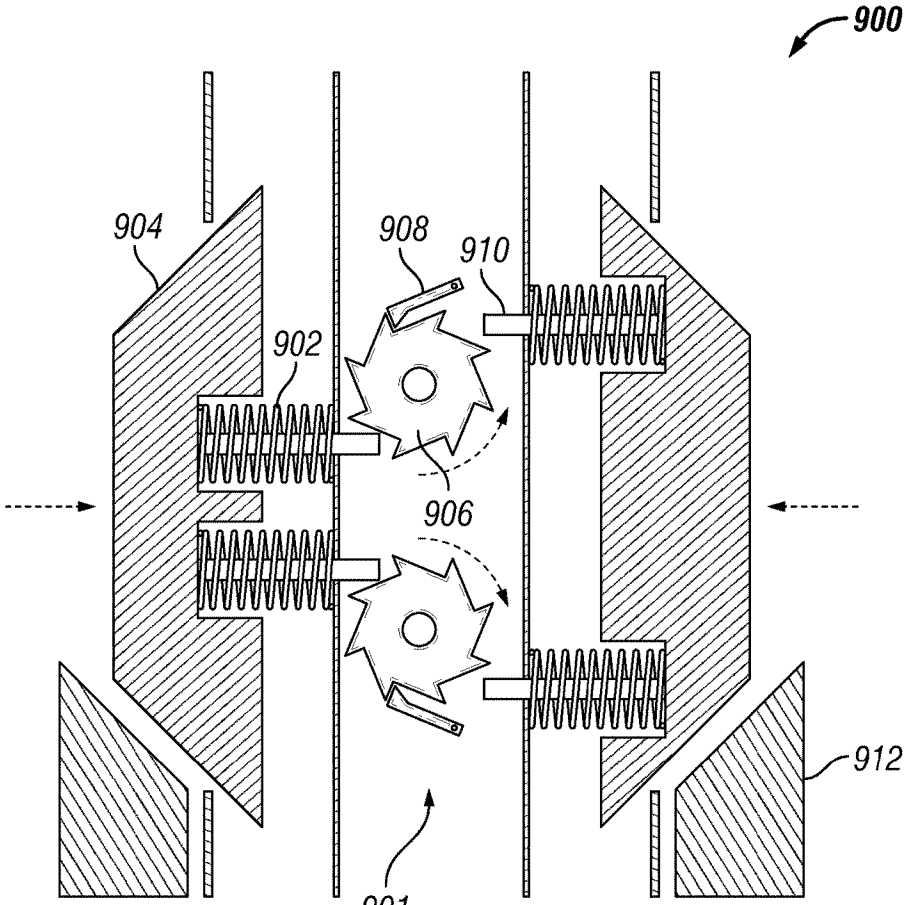
FIG. 9A illustrates a side, cross-sectional view of the collapsible shouldering dog and internal ratchet gear system of the plugging device, according to an embodiment.

FIG. 9A illustrates a cross-sectional view of a plugging device 900, according to an embodiment. The plugging device 900 may include a ratchet gear system 901. The ratchet gear system 901 may include one or more ratchet gears 906 and pawls 910. Inward motion of shouldering dogs 904 may cause the pawls 910 to engage the ratchet gear 906, causing the ratchet gear 906 to incrementally rotate as indicated, by way of example, using the dashed arrows of FIG. 9A. A second pawl 908 may be installed to prevent the ratchet gear 906 from reverse rotation.

Figure 9B:
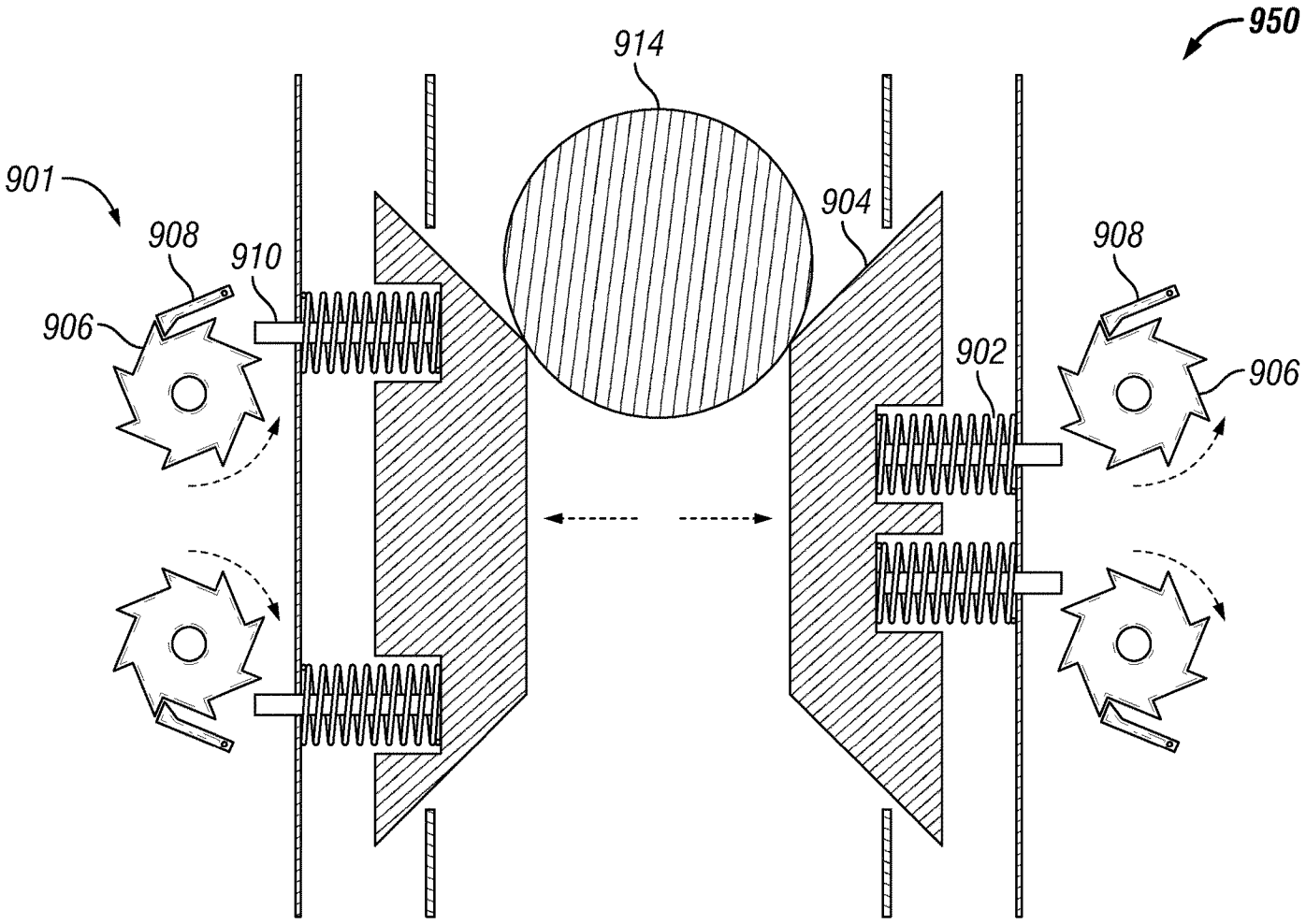
FIG. 9B illustrates a side, cross-sectional view of a ball seat with a ratcheting mechanism, according to an embodiment.

FIG. 9B illustrates a cross-sectional view of a valve 950, which may integrate the ratchet gear system 901 therein, according to an embodiment. As depicted in FIG. 9B, the ratchet system 901 may be installed within the valve 950, but, for example, outside of the flowpath within the valve 950. Accordingly, the shoulder dogs 904 may provide a valve seat upon which a plugging device 914 may land, either causing the ratchet gear system 901 to cycle and allow the shoulder dogs 904 to expand, or, after a predetermined number of cycles, the shoulder dogs 904 may catch and, e.g., seal with the plugging device 914. Although ratchet gears are depicted in the example shown in FIGS. 9A and 9B, other gearing mechanisms or electrical elements may be used.

Figure 10:
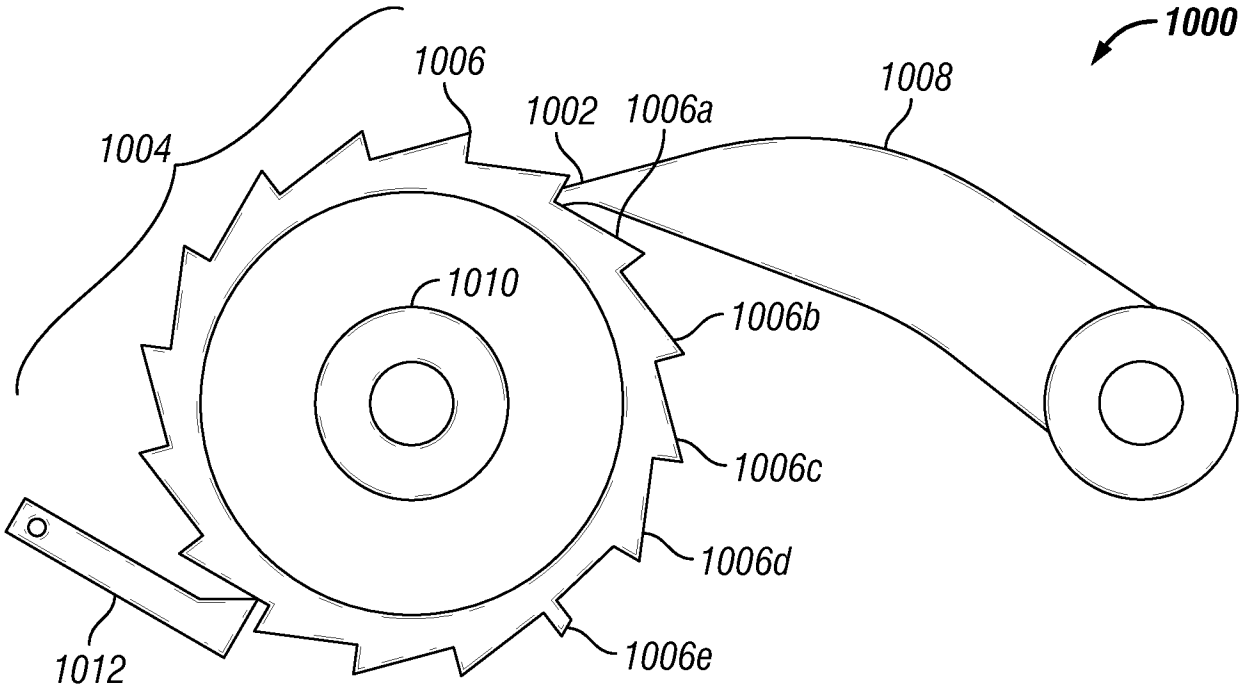
FIG. 10 illustrates a perspective view of a ratchet mechanism, according to an embodiment.

FIG. 10 illustrates a view of a ratchet mechanism 1000 for use with either or both of a plugging device containing a gear or ratchet system and a valve seat containing a gear or ratchet system, according to an embodiment. The ratcheting mechanism 1000 generally includes a shaft 1010, a ratchet wheel 1004 and a pawl 1008. The ratchet wheel 1004 includes a plurality of teeth 1006 which are in contact with a tip 1002 of the pawl 1008.

The ratcheting mechanism may have a spring that biases the pawl 1008 against the teeth 1006 of the ratchet wheel 1004. The amount of backward motion possible varies with the pitch of the teeth. This motion may be reduced by using small teeth, and/or several pawls side by side on the same axis, the pawls being of different lengths. The ratcheting mechanism 1000 may further include one or more additional pawls 1012 to prevent the ratchet wheel 1004 from making any unwanted movement or rotation.

When integrated with a valve seat, a ball drop triggers the valve such that the ratchet wheel 1004 may move counterclockwise and pawl 1008 will slide over a tooth 1006 incline and lock the wheel 1004 in place until the next drop triggers the ratchet mechanism. This process cycles until a predetermined number of cycles has been met. For example, the mechanism in FIG. 10 has a starting tooth 1006*a* and has been configured to run for 4 cycles by cutting a 90-degree angle in the fifth tooth 1006*e*. The 90° cut eliminates the slope thereby preventing the pawl 1008 from progressing to the next tooth. Once this has occurred, the next ball drop will be caught by the ball valve and used to plug the ball valve system and divert the force to fracture the well. Although the ratchet wheel 1004 of FIG. 10 moves in a counterclockwise direction, the ratchet wheel 1004 may easily be configured to rotate in clockwise direction by, for example, simply reversing the tooth angle and/or changing complementary structures.

While the description so far has centered on fracture applications, it would be clear to those of skill in the art having the benefit of this disclosure that it can equally be applied to other systems or conduit/pipe systems that use plugging devices and ball seats.

Thus, an apparatus for restricting flow through a conduit may include a counter for tracking and communicating a number of plug drops through a longitudinal bore, a plug element adapted to be dropped into the longitudinal bore, and a valve defining a plug seat to be disposed within the longitudinal bore to catch the plug element when the plug element is dropped and when the number of plug drops as communicated by the counter exceeds a predetermined number. The plug element may be, for example, a ball or a pump down plug.

The counter may be mechanical or electronic in nature. Mechanically, it might include, for example, a series of gears and ratchets. The electronic embodiments might operate optically through photosensor technology or through radio frequencies, such as RFID. The presently disclosed technique admits wide variation in how the counter may be implemented. The counter may be located on either the plug or the plug element.

In embodiments where the counter is located on the plug element, the plug element, may include not only the counter, but also a device or means for collapsing inwardly upon meeting a plug seat unless the communicated number of plug drops exceeds a predetermined number. In the illustrated embodiments, the means is one or more shouldering dogs that collapse inwardly upon encountering a plug seat until the counter indicates that the predetermined number of drops have been performed. Note that this embodiment infers the number of drops from the number of plug seats encountered. However, this is by way of example and illustration but one means for performing the disclosed function. Other means equivalent in structure that perform the function may be used in other, alternative embodiments.

In embodiments where the counter is located on the plug seat, a valve may include not only the counter, but a collapsible plug seat that collapses upon meeting a plug unless the communicated number of plug drops exceeds a predetermined number. The plug seat may collapse outwardly or downwardly in various embodiments. Note that this embodiment can count directly the number of plug drops.

In use, a method includes dropping a plurality of plugs down a longitudinal bore in which a plurality of plug seats are disposed. The number of plug drops is counted from within the longitudinal bore. For example, the number of drops may be counted inferentially by the plug element or directly by the plug seats, both as described above. At each plug seat, if the predetermined number of plug drops has not occurred, then the plug element passes through the plug seat as one or more structures and/or means collapses as described above and shown in the drawings. When the number of plug drops exceeds a predetermined number, then a preselected one of the plug seats catches the plug element.

Figure 11:
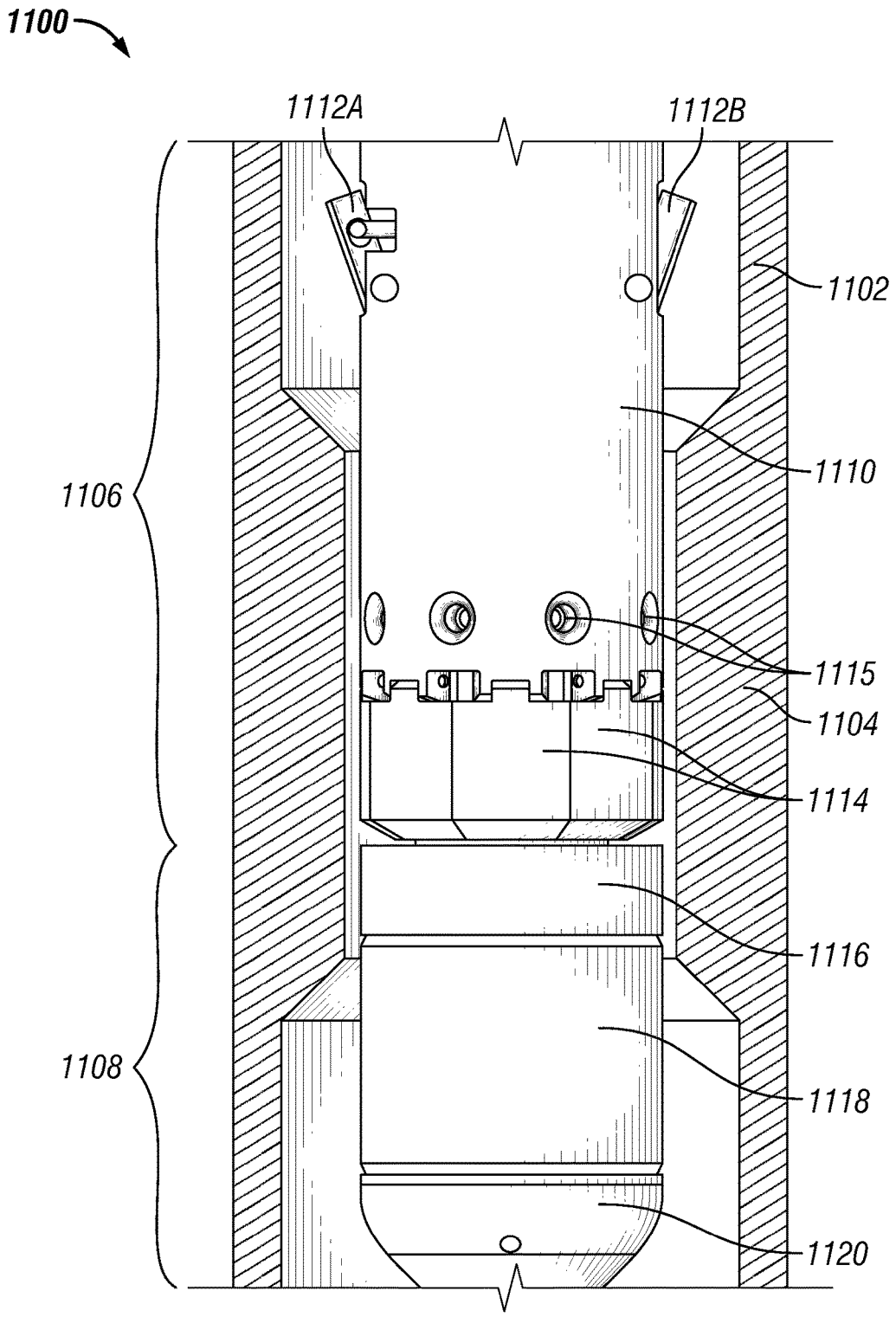
FIG. 11 illustrates a side view of a plugging device in a run-in configuration, disposed in a conduit, according to an embodiment.

FIG. 11 illustrates a side, perspective view of another plugging device 1100 in a first or "run-in" configuration, according to an embodiment. The plugging device 1100 may also be referred to as a "ball" or a "dart" in various contexts, without limitation. The plugging device 1100 may be configured to proceed through a conduit 1102, as well as any number of restrictions 1104 therein. In an embodiment, the restriction 1104 may represent a ball seat or valve seat of a stimulation valve, but in other embodiments, may represent any reduced-diameter section of a wellbore.

The plugging device 1100 may include an upper assembly 1106 and a lower assembly 1108. The upper assembly 1106 may include a housing 1110. The housing 1110 may define holes 1115, in which pins, rivets, or other attachment devices may be received, to anchor or otherwise couple with one or more internal components of the upper assembly 1106 and/or lower assembly 1108 disposed within the housing 1110. In some embodiments, the plugging device 1100 may also optionally include a skirt, such as a flexible elastomeric element that produces at least a partial seal with the wellbore, allowing the plugging device 1100 to be pumped down through the conduit 1102.

The plugging device 1100, e.g., the upper assembly 1106, may also include a trigger. For example, the trigger may include one or more trigger arms (two are shown: 1112A, 1112B) that may extend outwardly from the housing 1110 and may be, for example, pivotally connected therewith. Optionally, a torsion spring (not shown) or another biasing member may be provided to bias the one or more trigger arms 1112A, 1112B outwards.

The plugging device 1100 may also include an expandable member. For example, the expandable member may include one or more expandable shouldering or "actuating" dogs 1114, which may be pivotally coupled with the housing 1110 and/or with the lower assembly 1108. The actuating dogs 1114 may be segmented, and may expand radially apart from a first, contracted position (as shown) to a second, expanded position (see below, and, e.g., FIG. 19) in which the actuating dogs 1114 may engage and optionally seal with the restriction 1104. The actuating dogs 1114 may be biased toward the housing 1110, so as to maintain the actuating dogs 1114 in the illustrated, retracted position. Additionally or instead, the lower assembly 1108 may include a band received around or through the actuating dogs 1114, which may hold the actuating dogs 1114 in the retracted position, and may expand and/or rupture to allow expansion of the actuating dogs 1114.

Further, the actuating dogs 1114 may be made at least partially from a material that may dissolve in a certain fluid, and/or after a certain amount of time, so as to facilitate removal of the plugging device 1100 from the conduit 1102. In some embodiments, other components of the plugging device 1100 may be made from a dissolvable material, and/or the restriction 1104 may be at least partially made from a dissolvable material. In an embodiment, the dissolvable material may be coated with a material that may delay the dissolving by a certain amount of time. In other embodiments, the various components of the plugging device 1100 and/or the restriction 1104 may not be dissolvable.

The lower assembly 1108 may include a mandrel stop 1116, a sealing element 1118, and a dart nose 1120. The sealing element 1118 may be elastomeric or otherwise made of a material which is expandable radially outwards, e.g., to seal with a surrounding tubular (e.g., a restriction like the illustrated restriction 1104). The dart nose 1120 may be any structure that extends below the expandable element, e.g., past the actuating dogs 1114 and/or the sealing element 1118, and may have a rounded profile, as shown. When the actuating dogs 1114 are in the retracted position, the mandrel stop 1116 may extend farther radially outward than the actuating dogs 1114, which may protect the actuating dogs 1114 during run-in.

Figure 12:
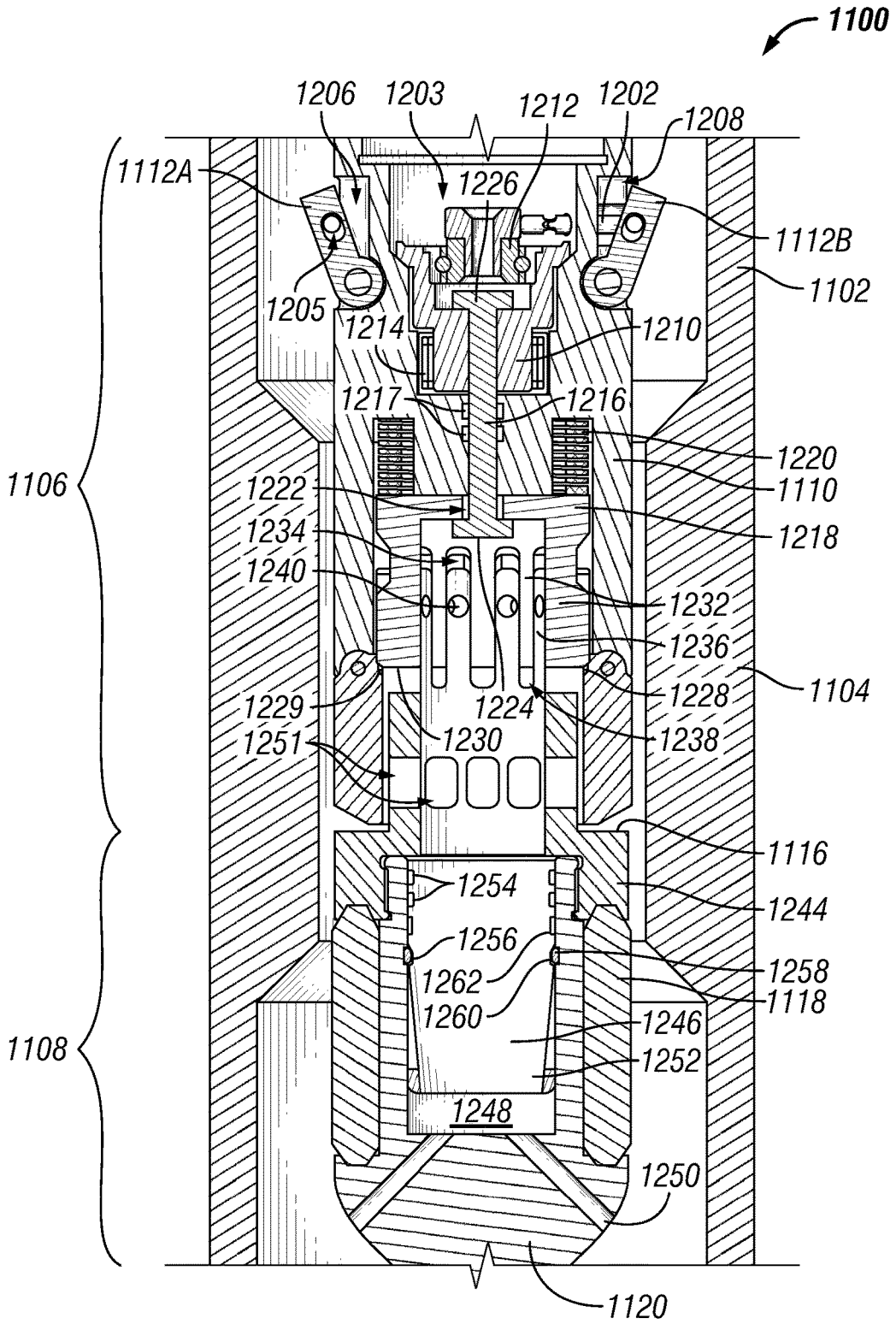
FIG. 12 illustrates a side, cross-sectional view of the plugging device in the conduit, according to an embodiment.

FIG. 12 illustrates a cross-sectional view of the plugging device 1100 in the run-in configuration, according to an embodiment. As shown, the trigger arms 1112A, 1112B may be pivotally coupled with the housing 1110, as well as with linkages 1200, 1202, (1200 is not visible in FIG. 12), respectively. In some embodiments, the linkages 1200, 1202 may be sealed within the housing 1110, but in others, may not be sealed therein. The linkages 1200, 1202 may be part of a counter or "counting assembly" 1203. In an embodiment, the trigger arms 1112A, 1112B may include a hole 1205, through which the linkages 1200, 1202 may be received. As such, the trigger arms 1112A, 1112B pivoting toward the housing 1110 may apply an inward force on the linkages 1200, 1202, as will be described in greater detail below.

The trigger arms 1112A, 1112B may be at least partially positionable within pockets 1206, 1208, respectively, formed in the housing 1110. The pockets 1206, 1208 may, for example, be at least as large as the trigger arms 112A, 1112B, thus allowing the trigger arms 1112A, 1112B to be positioned fully within the pockets 1206, 1208, to ensure passage of the plugging device 1100 through the restriction 1104. In other embodiments, the pockets 1206, 1208 may be smaller, for example, when restriction sizes in the wellbore are significantly larger than the outer diameter of the housing 1110.

The counting assembly 1203 may include a ratchet, such as a ratchet cylinder 1210 that is rotatably seated within the housing 1110, e.g., within an upper end of the housing 1110, as shown. The counting assembly 1203 may also include a pair of bearings 1212, 1214. The first bearing 1212 may provide for rotation between the ratchet cylinder 1210 and an actuating arm (described below), while the second bearing 1214 may provide for rotation between the ratchet cylinder 1210 and the housing 1110. In an embodiment, the second bearing 1214 may be a one-way bearing, which may permit rotation in one direction, but prevent reverse rotation.

The upper assembly 1106 may also include an actuator configured to expand the expandable member (e.g., the actuating dogs 1114). The actuator may include a restraining member, such as a pivot shaft 1216. The pivot shaft 1216 may include a key head 1224 and an actuation head 1226. The actuation head 1226 may be engaged by the counting assembly 1203, causing the pivot shaft 1216 to rotate, as will be described, according to an embodiment below. Further, the pivot shaft 1216 may be sealed with the housing 1110 using sealing elements (e.g., O-rings) 1217.

The upper assembly 1106 may also include a mandrel 1218 and a biasing member 1220, such as a compression spring (or any other potential energy source that may be employed to move the shifting mandrel 1218), which may both be part of the actuator, in some embodiments. The biasing member 1220 may be disposed between the mandrel 1218 and the housing 1110, and, prior to actuation of the plugging device 1100, may be in a stored-energy state. In the run-in configuration of the plugging device 1100, the pivot shaft 1216 may be received through the keyhole 1222 of the mandrel 1218. The key head 1224 of the pivot shaft 1216 may be shaped such that the pivot shaft 1216 is prevented from sliding out of the keyhole 1222 unless the pivot shaft 1216 is rotated to a particular orientation. Further, the actuation head 1226 may be received through the ratchet cylinder 1210 and prevented from being removed by axial sliding therefrom. Accordingly, the pivot shaft 1216 may prevent the biasing member 1220 from pushing the mandrel 1218 toward the actuating dogs 1114, away from the counting assembly 1203 (e.g., the ratchet cylinder 1210), and/or otherwise toward an expanded configuration of the plugging device 1100 in which the actuating dogs 1114 are expanded.

The actuating dogs 1114 may include an inward engagement surface 1228. The inward engagement surface 1228 of the actuating dogs 1114 may be engageable with a corner 1229 of the mandrel 1218, e.g. at or proximal to a lower end 1230 thereof. In some embodiments, this engagement may be a rotating/sliding engagement. In other embodiments, other engaging features, such as gear teeth, may be provided on the mandrel 1218 and/or actuating dogs 1114, so as to function similar to a rack-and-pinion.

The mandrel 1218 may also include fingers 1232 separated circumferentially apart by slots 1234. Similarly, the mandrel stop 1116 may include fingers 1236 separated circumferentially apart by slots 1238. The fingers 1232 of the mandrel 1218 may be received into the slots 1238 of the mandrel stop 1116, and the fingers 1236 of the mandrel stop 1116 may be received into the slots 1234 of the mandrel 1218. This interleaving of the fingers 1232, 1236 may allow sliding between the mandrel 1218 and the mandrel stop 1116, but may prevent relative rotation therebetween.

Further, the mandrel stop 1116 may include pin holes 1240 through at least some of the fingers 1236 thereof. The pin holes 1240 may align with the holes 1115 in the housing 1110 (FIG. 11), such that attachment devices may be received through the holes 1115 and 1240, thereby coupling the mandrel stop 1116 to the housing 1110, such that the mandrel stop 1116 may be prevented from rotation and/or sliding (e.g., up-and-down, as shown) relative to the housing 1110.

The mandrel stop 1116 may also include a first body portion 1242 and a second body portion 1244. The first body portion 1242 may have a smaller outer diameter than the second body portion 1244. Further, the first body portion 1242 may be received radially within the actuating dogs 1114, and the fingers 1236 may extend therefrom. The second body portion 1244 may extend axially therefrom and may engage the dart nose 1120 and the sealing element 1118.

The lower assembly 1108 may also include a piston 1246 positioned with a chamber 1248 defined at least partially in the dart nose 1120. One or more pressure ports (two are shown) 1250 formed in the dart nose 1120 may communicate with the chamber 1248 and a region below the dart nose 1120. One or more pressure ports (four are shown) 1251 may communicate an interior of the mandrel stop 1116 with an exterior of the plugging device 1100, e.g., above the dart nose 1120. The piston 1246 may also include a conical section 1252, which may be tapered so as to decrease in diameter proceeding toward the bottom of the plugging device 1100 (e.g., toward the dart nose 1120 where the pressure ports 1250 are defined).

Figure 13A:
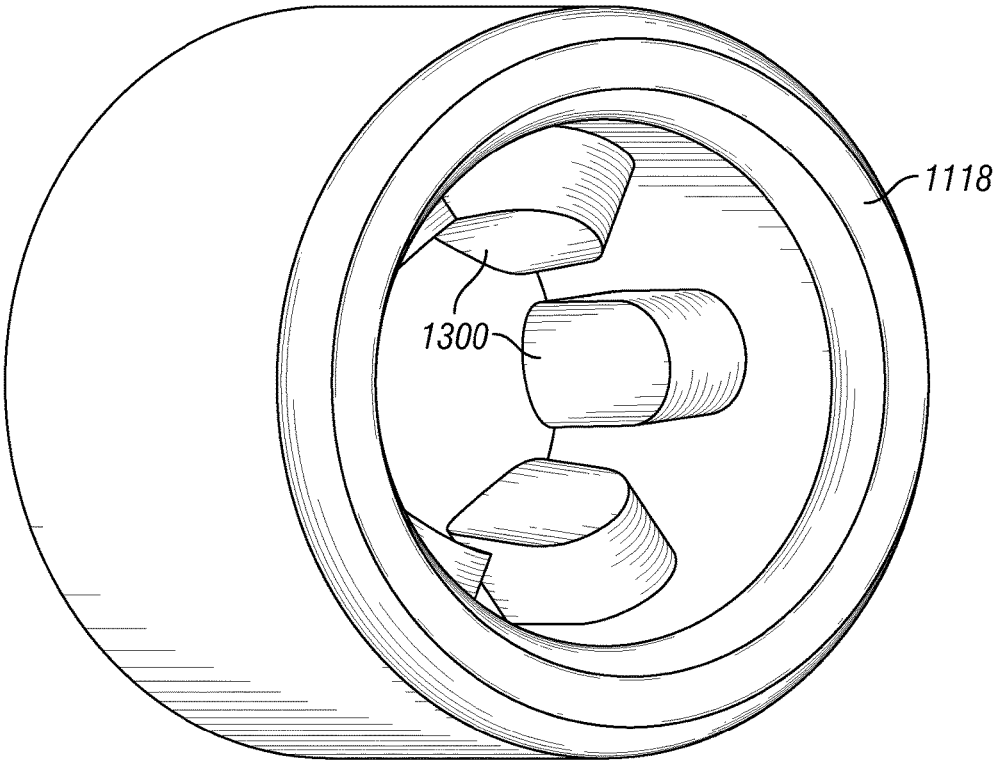
FIG. 13A illustrates a perspective view of a sealing element, according to an embodiment.
Figure 13B:
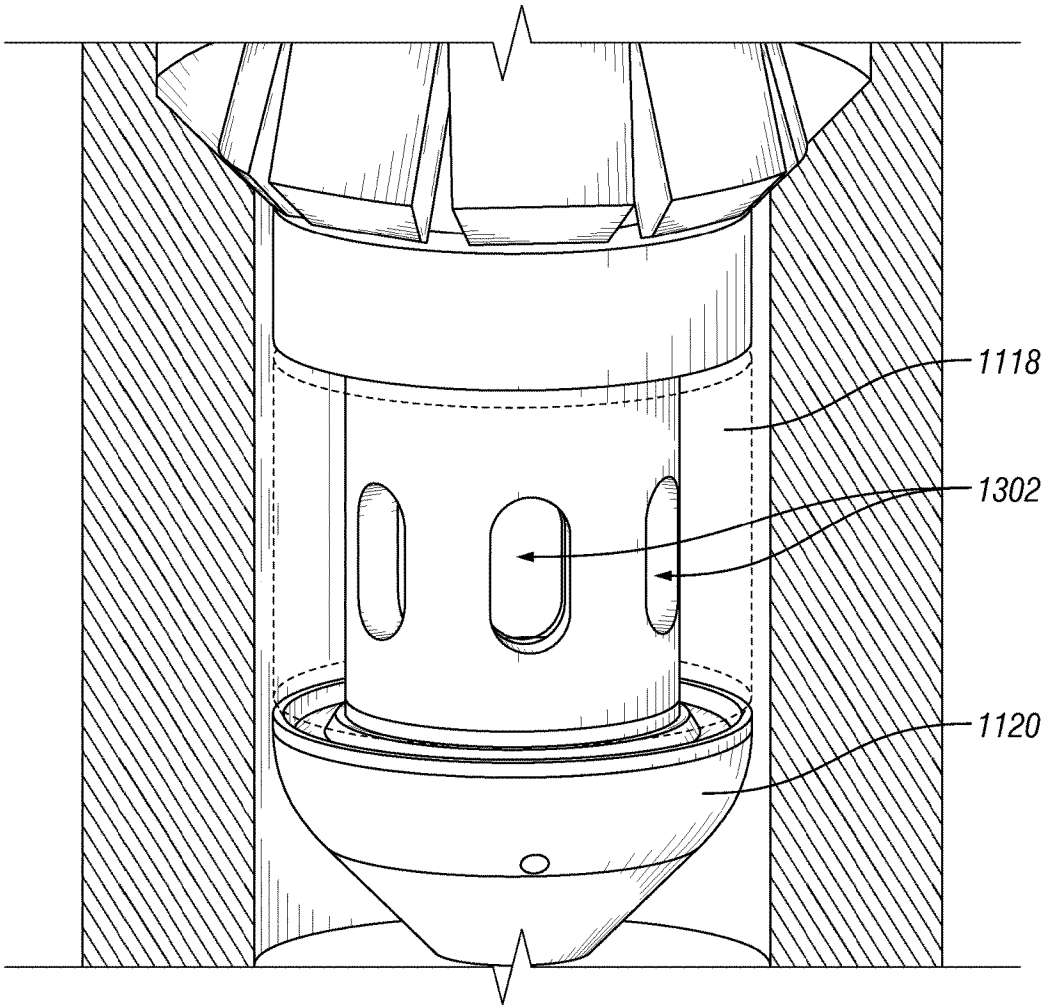
FIG. 13B illustrates a perspective view of a dart nose, according to an embodiment.

Referring additionally to FIGS. 13A and 13B, there is shown a perspective view of the sealing element 1118 and the dart nose 1120 (with the sealing element 1118 shown as transparent), according to an embodiment. As shown in FIG. 13A, the sealing element 1118 may include a plurality of protrusions 1300, which may extend radially inward and, when assembled on the dart nose 1120, the protrusions 1300 may extend through slots 1302 formed in the dart nose 1120. Further, the protrusions 1300 may be tapered complementary to the taper of the conical section 1252 of the piston 1246. Accordingly, when the piston 1246 moves downward, the piston 1246 slides along the protrusions 1300 and drives the protrusions 1300 radially outwards, thus expanding the sealing element 1118.

Still referring to FIG. 12, the piston 1246 may prevent fluid communication between an interior of the mandrel stop 1116 and the chamber 1248, for example, using seals (e.g., O-rings) 1254 positioned between the piston 1246 and the dart nose 1120. Accordingly, a pressure differential therebetween may be applied to the piston 1246, so as to drive the piston 1246 in the direction of lower pressure. In addition, the lower assembly 1108 may include a lock ring 1256, which may be received in a groove 1258 formed in the dart nose 1120 and an angled groove 1260 formed in the piston 1246. The lock ring 1256 may prevent movement of the piston 1246 until a pressure differential of sufficient magnitude, and in a direction tending to drive the piston 1246 downward, is applied. At that point, the lock ring 1256 may expand by riding along the angled groove 1260, until being received into a second groove 1262 in the piston 1246 (or until the piston 1246 is stopped by other forces). The lock ring 1256 in the second groove 1262 may prevent reverse movement of the piston 1246 in the absence of the aforementioned pressure differential of sufficient magnitude and certain direction (e.g., when the pressure differential is reduced).

Figure 14:
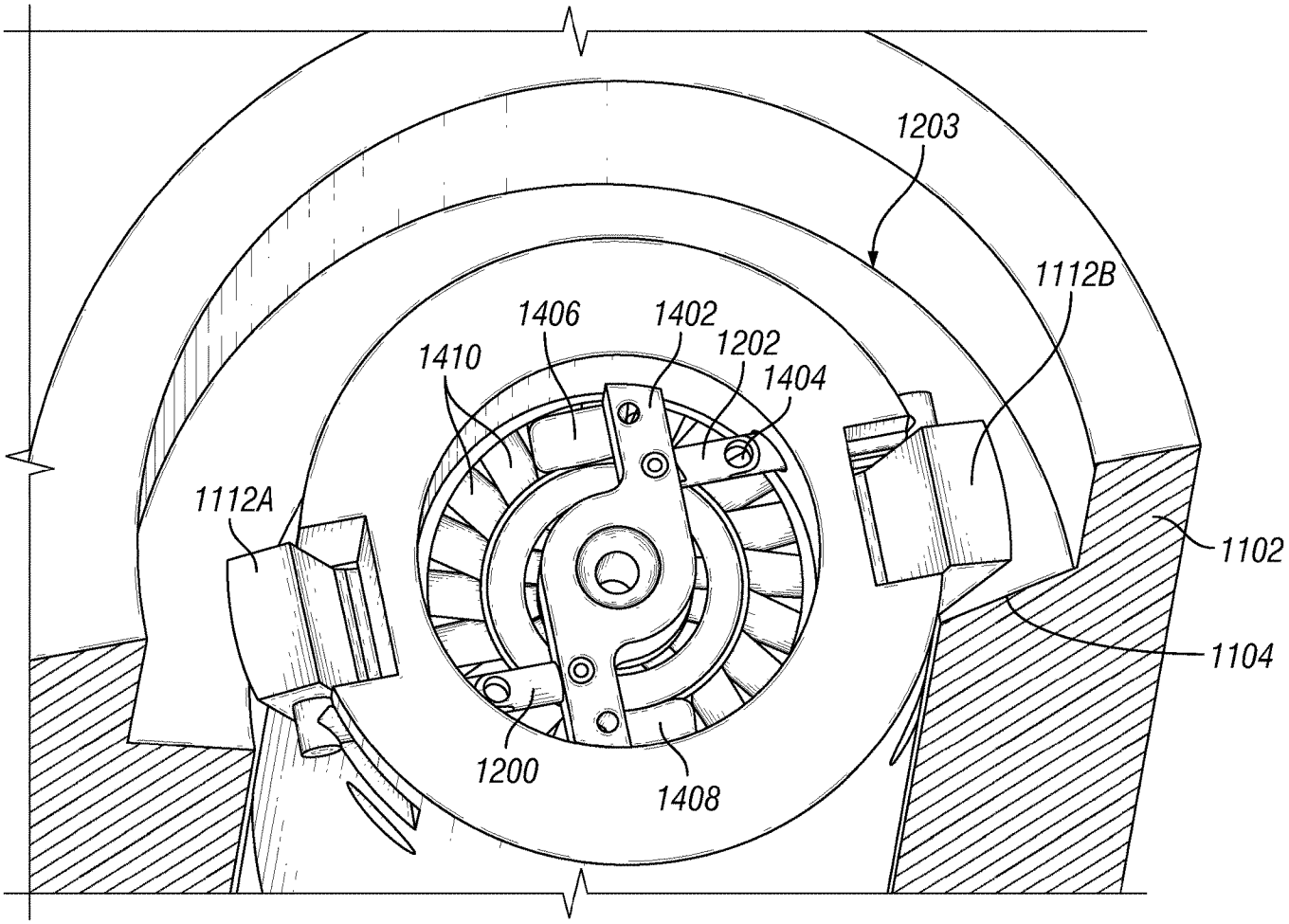
FIG. 14 illustrates a perspective view of the plugging device, showing the counting assembly thereof, according to an embodiment.

FIG. 14 illustrates a raised, perspective view of the counting assembly 1203, according to an embodiment. In particular, the counting assembly 1203 is shown as the plugging device 1100 is disposed in the conduit 1102, in the run-in configuration, and just prior to proceeding into the restriction 1104. At this point, the trigger arms 1112A, 1112B are expanded outwards, although potentially not far enough outwards to contact the conduit 1102, prior to entering the restriction 1104. Further, as mentioned above, the trigger arms 1112A, 1112B may be pivotally coupled with the housing 1110 and the linkages 1200, 1202.

The linkages 1200, 1202 extend inwards to an pawl arm 1402 of the counting assembly 1203. Further, the linkages 1200, 1202 may be able to bend or pivot, e.g., by providing a pivot joint 1404 in each. The pawl arm 1402 may be rotatably supported in the ratchet cylinder 1210 (see FIG. 12) via the first bearing 1212. Further, the pawl arm 1402 may include one or more pawls (two are shown: 1406, 1408). The pawls 1406, 1408 may engage ratchet teeth 1410 of the ratchet cylinder 1210.

In one example, the pawls 1406, 1408 may push in a counterclockwise direction on the ratchet teeth 1410 when the trigger arms 1112A, 1112B are pivoted toward the housing 1110. In other examples, however, the pawls 1406, 1408 may include hooks or other engaging members that may pull on the ratchet teeth 1410 when the trigger arms 1112A, 1112B pivot away from the housing 1110. In the illustrated embodiment, the pawls 1406, 1408 may be elastically deformable, so as to be movable over the individual teeth 1410 and onto an adjacent tooth 1410, while providing sufficient rigidity to transmit force onto the teeth 1410 to cause the ratchet cylinder 1210 to rotate. The counting assembly 1203 may also include a biasing member, such as a extension spring that biases the pawl arm 1402 against movement imposed by the pivoting of the trigger arms 1112A, 1112B, thereby causing the trigger arms 1112A, 1112B to pivot outwards once past the restriction 1104.

Figure 15A:
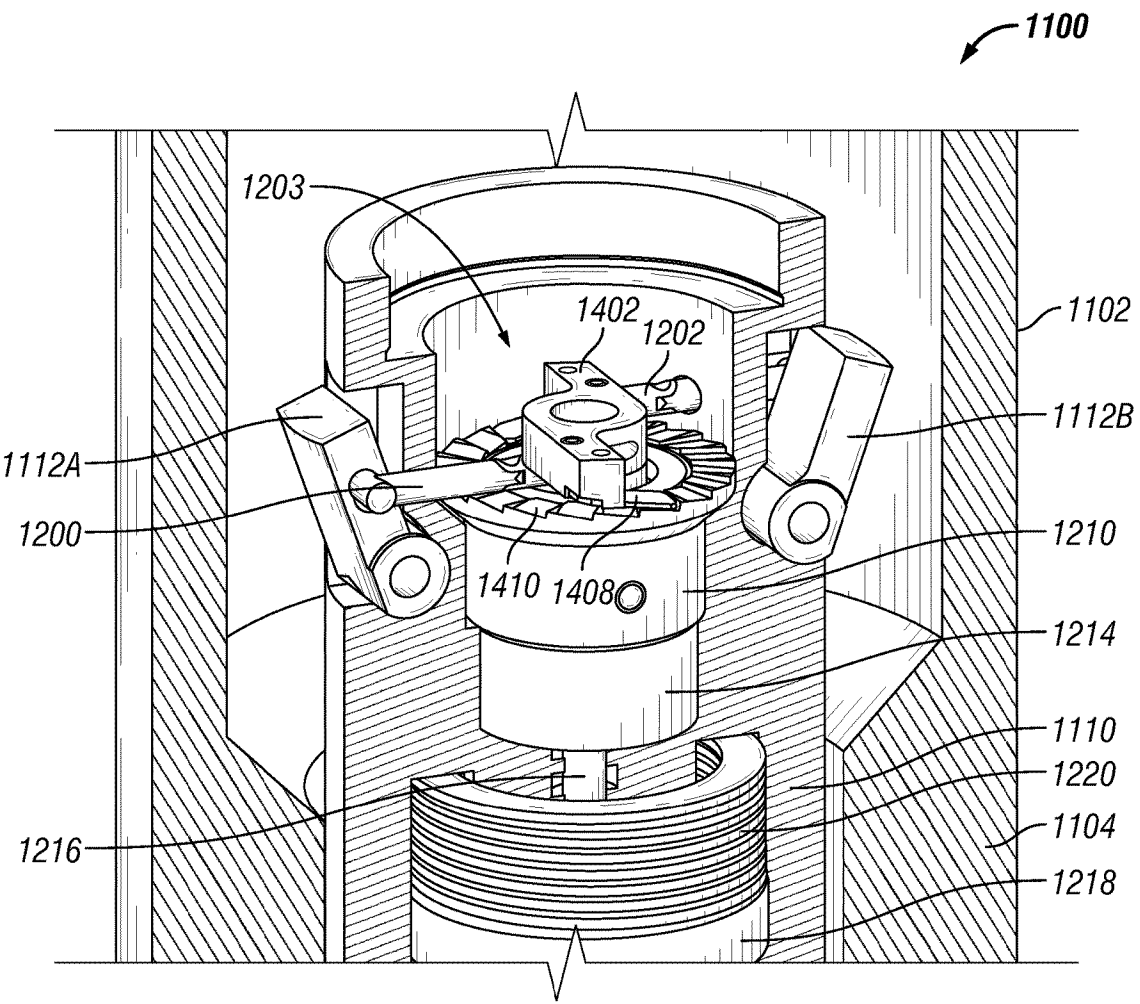
FIG. 15A illustrates a cross-sectional view of the plugging device, showing the counting assembly thereof, according to an embodiment.
Figure 15B:
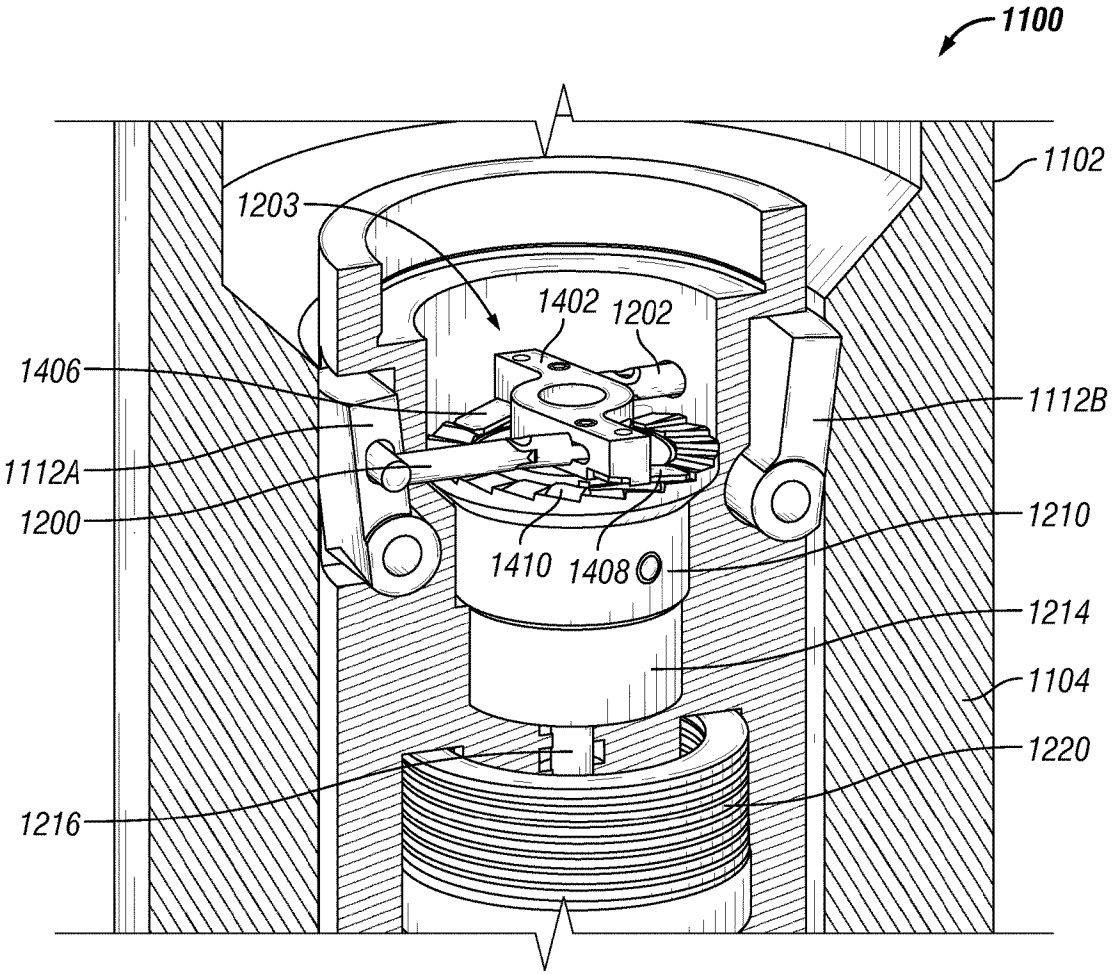
FIG. 15B illustrates a cross-sectional view of the plugging device, showing the trigger arms pivoting inward, according to an embodiment.
Figure 15C:
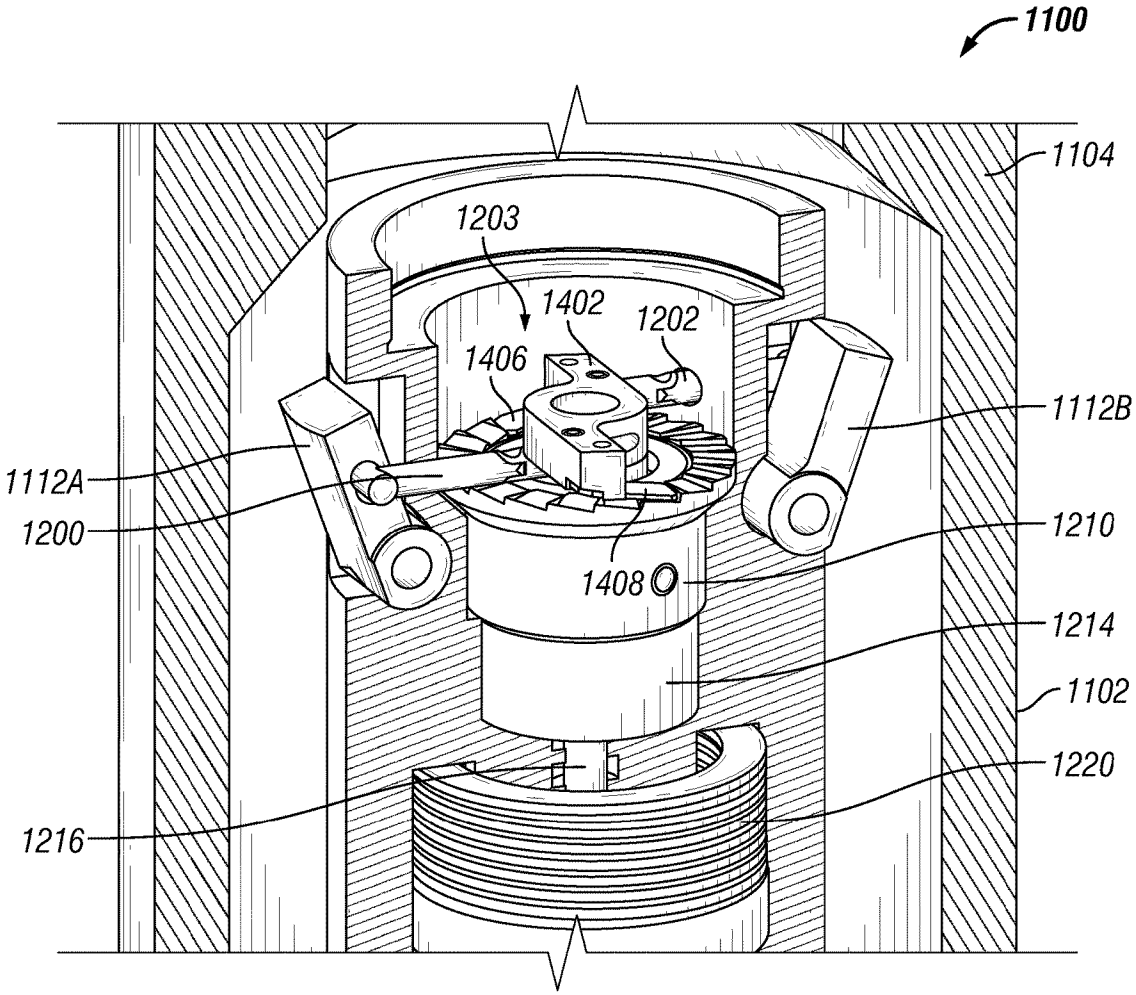
FIG. 15C illustrates a cross-sectional view of the plugging device, after proceeding through a restriction, according to an embodiment.

FIGS. 15A-15C illustrate cross-sectional views of the plugging device 1100, in three different stages of operation, according to an embodiment. Although the plugging device 1100 is depicted as having an open end that exposes the counting assembly 1203, it will be readily appreciated that a cap or top may be employed to seal and/or otherwise protect the counting assembly 1203 from the wellbore environment.

As shown in FIG. 15A, prior to entering the restriction, the plugging device 1100 may be in the run-in configuration, with the trigger arms 1112A, 1112B rotated outward, away form the housing 1110, the biasing member 1220 compressed against the mandrel 1218, with the mandrel 1218 prevented from moving under the force of the biasing member 1220 by the pivot shaft 1216.

Proceeding to FIG. 15B, the plugging device 1100 has moved the trigger arms 1112A, 1112B into the restriction 1104. As such, the trigger arms 1112A, 1112B have pivoted toward the housing 1110 and into the pockets 1206, 1208, which prevents the trigger arms 1112A, 1112B, once folded inwards, from substantially impeding the progress of the plugging device 1100 in the conduit 1102.

Such pivoting of the trigger arms 1112A, 1112B causes the linkages 1200, 1202 attached thereto to push inward on the pawl arm 1402. The linkages 1200, 1202 may be offset from the axis of rotation of the pawl arm 1402, and thus the force applied thereto by the pivoting trigger arms 1112A, 1112B via the linkages 1200, 1202 may be converted to torque on the pawl arm 1402. Thus, the pawl arm 1402 is driven to rotate, while the pawls 1406, 1408 engage and, at least in this embodiment, push against the teeth 1410 of the ratchet cylinder 1210 and cause the ratchet cylinder 1210 to rotate (from left to right in the illustrated view). The rotation of the ratchet cylinder 1210 may be proportional to the stroke length of the linkages 1200, 1202 and thus proportional to the arc length of the pivoting of the trigger arms 1112A, 1112B.

FIG. 15C illustrates the plugging device 1100 after passing through the restriction 1104. As shown, the trigger arms 1112A, 1112B have pivoted away from the housing 1110, e.g., via the biasing member 1220. During such pivoting, the pawl arm 1402 may be pulled via the linkages 1200, 1202 back toward the original rotational position of the pawl arm 1402 (relative to the housing 1110). While rotating back, the pawls 1406, 1408 may deflect upwards, as they are drawn back across the inclined teeth 1410, until falling over a ledge of one tooth 1410 and onto the adjacent tooth 1410. Depending, for example, on the stroke length of the trigger arms 1112A, 1112B, in a single cycle, the pawls 1406, 1408 may be drawn across one or more of the teeth 1410. After falling onto an adjacent tooth 1410, the pawls 1406, 1408 may be in position for the next cycle of the trigger arms 1112A, 1112B pivoting toward the housing 1110.

As mentioned above, the pawls 1406, 1408 may, rather than pushing on the teeth 1410, be configured to pull on the teeth 1410, e.g., when the trigger arms 1112A, 1112B pivot outwards. For example, the pawls 1406, 1408 may include hooks configured to grab the teeth 1410, which may include complementary structures to engage the hooks.

Further, although two pawls 1406, 1408, corresponding to two trigger arms 1112A, 1112B, are shown, it will be appreciated that one, two, three, or more pawls 1406, 1408 and/or one, two, three, or more trigger arms 1112A, 1112B may be employed, without limitation. In some embodiments, a gear assembly may be provided to adjust the amount of rotation of the ratchet cylinder 1210 in response to a cycle of the trigger arms 1112A, 1112B. For example, the pawl arm 1402 may provide a sun gear, while the ratchet cylinder provides the ring gear, with one or more planetary gears being disposed therebetween. In another embodiment, the gearing system may provide an operation similar to an odometer, whereby the ratchet cylinder 1210 moves incrementally after a certain number (greater than one) of cycles of the trigger arms 1112A, 1112B.

In some embodiments, the plugging device 1100 may be prevented from registering "false" counts. For example, a trigger arm 1112A might be depressed prior to deploying the plugging device 1100 into a wellbore, or the trigger arm 1112A might be cycled by pressure or engagement with the conduit 1102 prior to arriving at a restriction 1104. To avoid this, a lock-out mechanism may be provided. The lock-out mechanism may be temperature or pressure sensitive, so as to prevent the counting assembly 1203 from counting cycles of the trigger arms 1112A, 1112B prior to arrival at a specific depth in the wellbore. In other embodiments, the lock-out mechanism may operate to prevent counting unless a two-part trigger is cycled. For example, depressing one of the trigger arms 1112A, without depressing the other trigger arm 1112B, may not increment the counting assembly 1203. In another example, two different types of triggers (e.g., the trigger arms 1112A, 1112B and a magnetic sensor) may be used to detect passage through a restriction 1104, and the counting assembly 1203 may increment when both triggers are simultaneously (or nearly so) triggered. A mechanical isolator may also be implemented on any type of trigger. An interface between the trigger arm and counter may incorporate an isolator that allows low-frequency, long duration inputs to transfer to the counter, but absorbs or attenuates any high frequency inputs. This acts as a mechanical low-pass filter to filter out extraneous, short-duration inputs caused by contact with other wellbore features.

Figure 16:
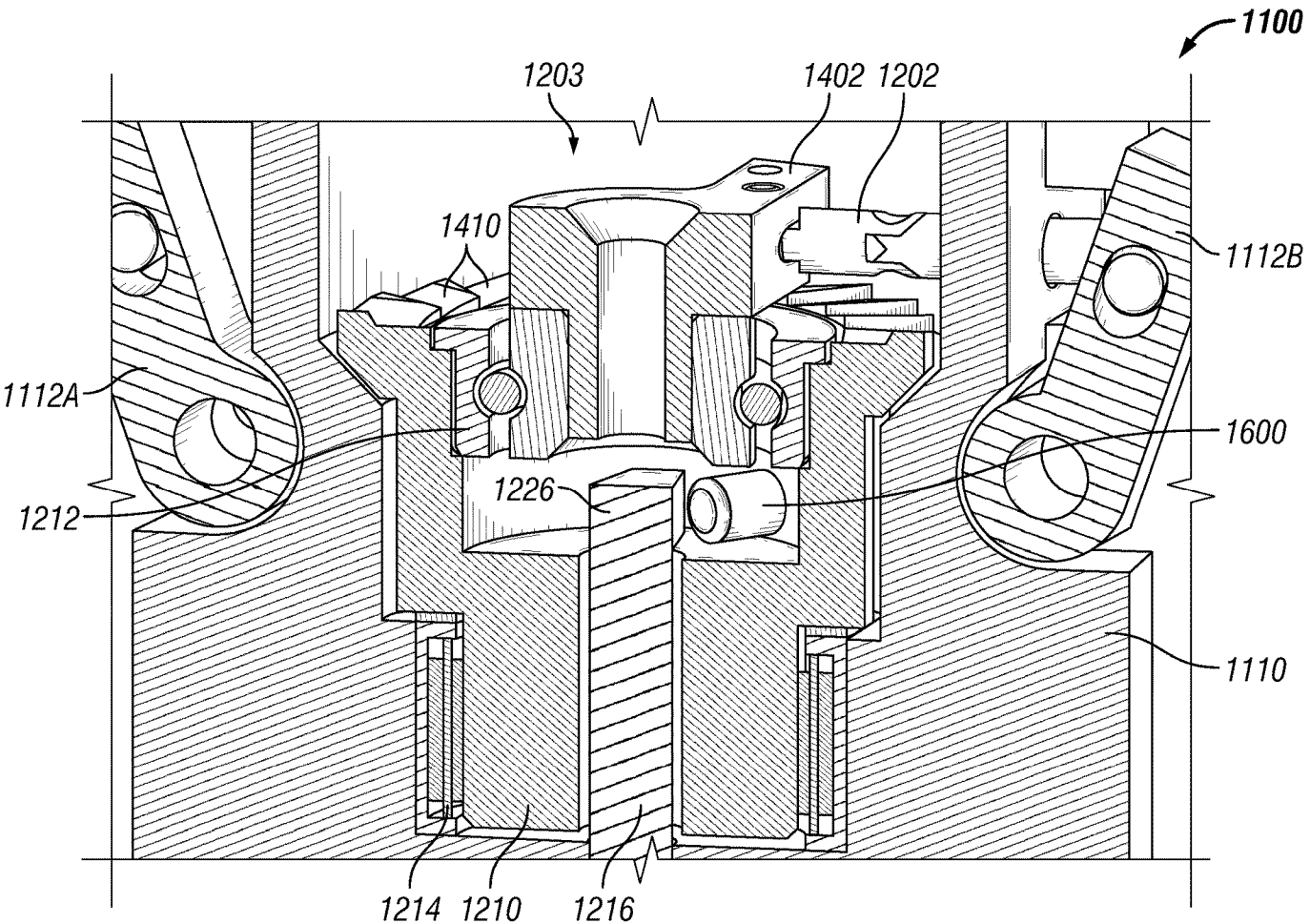
FIG. 16 illustrates an enlarged, cross-sectional view of the counting assembly of the plugging device, according to an embodiment.

FIG. 16 illustrates a partial, perspective view of the plugging device 1100, according to an embodiment. In particular, FIG. 16 illustrates the transmission of the rotation in the counting assembly 1203 (e.g., the ratchet cylinder 1210) to the pivot shaft 1216. For example, as shown, the counting assembly 1203 may include one or more trigger pins 1600, which may extend radially inward from the ratchet cylinder 1210. In other embodiments, the trigger pin 1600 may extend axially from a radially-oriented surface of the ratchet cylinder 1210. It will be appreciated that the trigger pin 1600 may be coupled directly to the ratchet cylinder 1210 or coupled thereto via one or more intermediate structures, without departing from the scope of the term "coupled to."

The trigger pin 1600 may thus rotate with each stroke of the trigger arms 1112A, 1112B along with the ratchet cylinder 1210. At some point during the successive cycles of the counting assembly 1203, the trigger pin 1600 may engage the actuation head 1226 of the pivot shaft 1216. Once such engagement occurs, subsequent rotation of the ratchet cylinder 1210 may cause the pivot shaft 1216 to rotate as well. In some embodiments, two or more trigger pins 1600 may be employed. Further, the trigger pin 1600 may begin, as an initial position, any number of degrees rotationally away from engagement with the actuation head 1226, including zero degrees.

Figure 18:
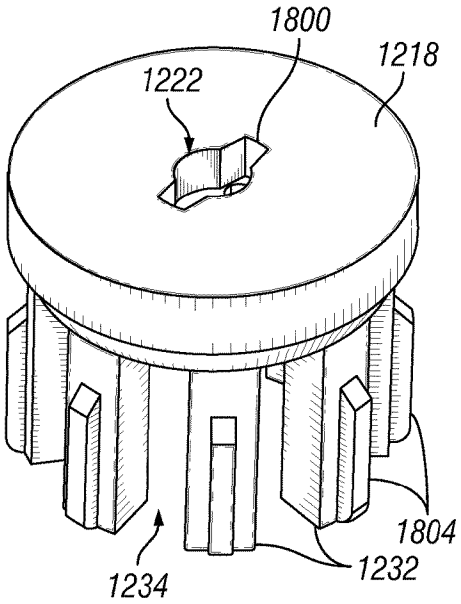
FIG. 18 illustrates a perspective view of the mandrel, according to an embodiment.
Figure 17:
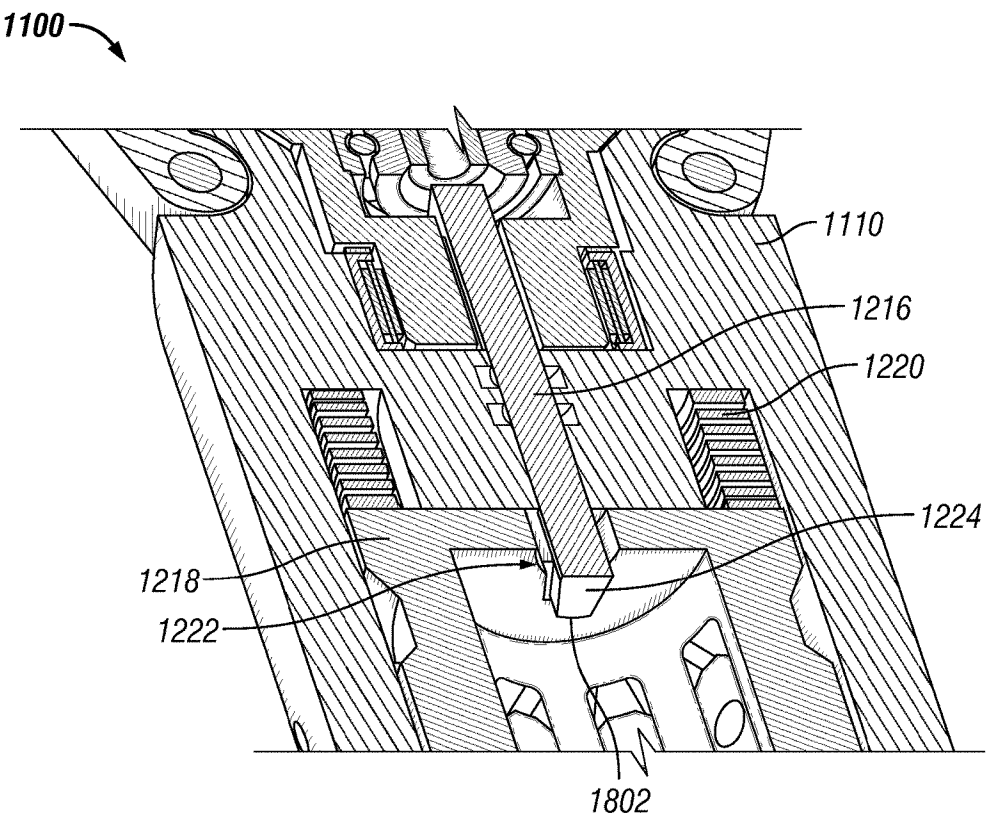
FIG. 17 illustrates a cross-sectional view of the plugging device, showing the interaction between the pivot piston and the mandrel, according to an embodiment.

FIG. 17 illustrates an enlarged, sectional view of the plugging device 1100, according to an embodiment. As shown, the rotation of the pivot shaft 1216 may cause the key head 1224 thereof to line up with the keyhole 1222. In particular, as best shown in FIG. 18, the keyhole 1222 in the mandrel 1218 may include a slot 1800. The key head 1224 may define one or more (e.g., two) protrusions which may be sized to fit through the slot 1800 when aligned therewith, but which may prevent the pivot shaft 1216 from releasing from the mandrel 1218 when the protrusion 1802 is not aligned with the slot 1800. Accordingly, the cycling of the counting assembly 1203 may incrementally rotate the pivot shaft 1216 from a position where the protrusion 1802 of the key head 1224 is misaligned from the slot 1800 to a position where the protrusion 1802 is aligned with the slot 1800.

FIG. 18 also illustrates the fingers 1232 and slots 1234 of the mandrel 1218. As shown, the fingers 1232 may include alignment ridges 1804. The alignment ridges 1804 may be received into grooves within the housing 1110 (see, e.g., FIG. 12), which may further prevent the mandrel 1218 from rotating relative to the housing 1110, e.g., from friction between the rotation of the key head 1224 and the mandrel 1218.

Figure 19:
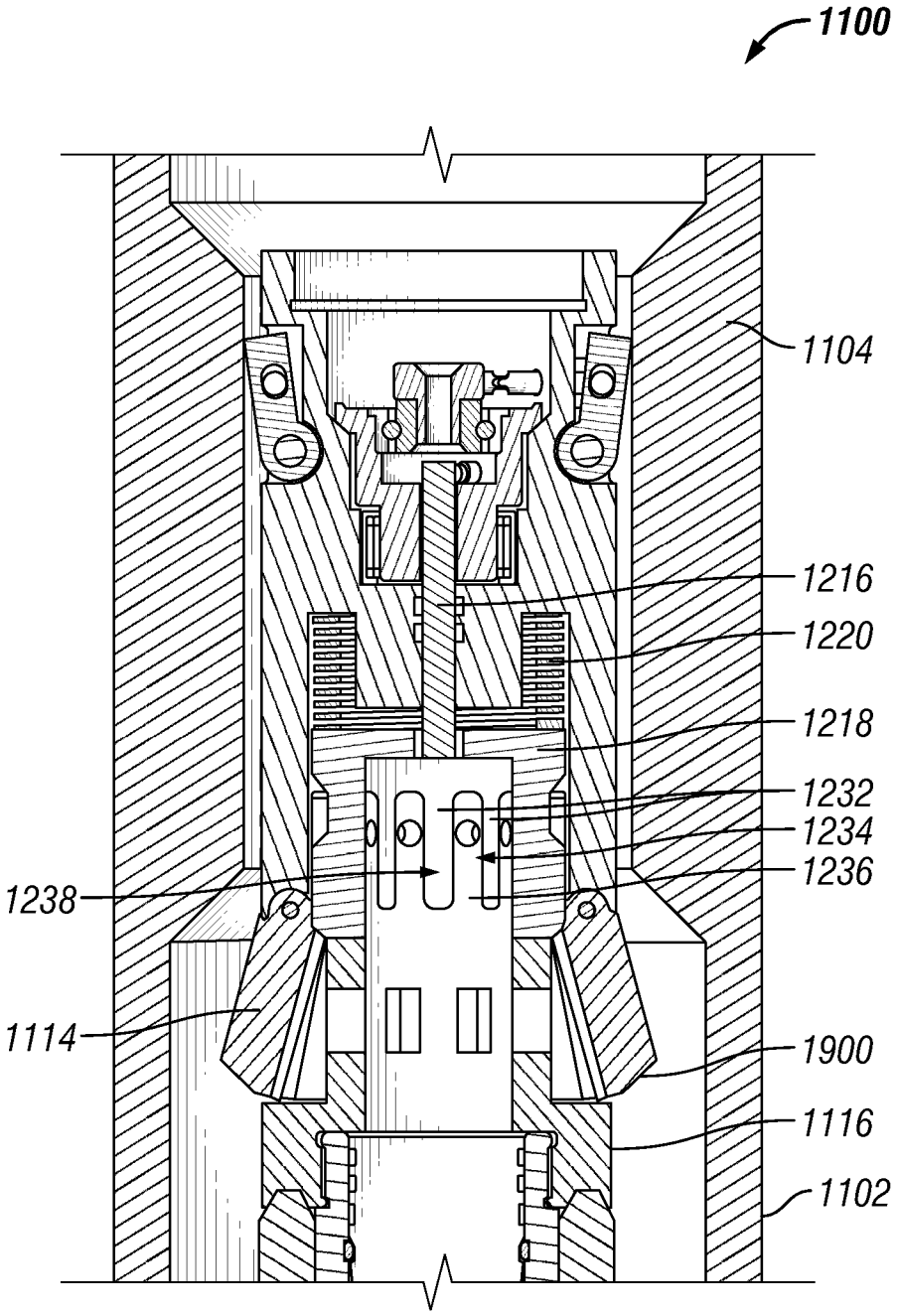
FIG. 19 illustrates a side, cross-sectional view of the plugging device in an expanded configuration, according to an embodiment.

FIG. 19 illustrates a partial, cross-sectional view of the plugging device 1100, particularly the upper assembly 1106 thereof, according to an embodiment. The plugging device 1100 is illustrated with the actuating dogs 1114 in the second, expanded position, e.g. after the plugging device 1100 passes through a predetermined number of restrictions 1104 in the conduit 1102.

In the illustrated embodiment, once the key head 1224 of the pivot shaft 1216 aligns with the keyhole 1222, the mandrel 1218 may be pushed away from the counting assembly 1203 (e.g., downward, as shown), such that the pivot shaft 1216 may be withdrawn from the mandrel 1218. The mandrel 1218 may be forced to move in this direction by the biasing member 1220.

As the mandrel 1218 moves, it may engage the actuating dogs 1114, causing them to pivot relative to the housing 1110, e.g., radially outwards, as shown. In particular, the actuating dogs 1114 may be rotated outward far enough that a distal end 1900 thereof may be positioned to engage a subsequent restriction, as will be described below. The movement of the mandrel 1218 may be limited by the mandrel stop 1116. In particular, the fingers 1232 of the mandrel 1218 may bottom-out in the slots 1238 of the mandrel stop 1116 and/or the fingers 1236 of the mandrel stop 1116 may bottom-out in the slots 1234 of the mandrel 1218. In either case, the mandrel stop 1116 may thus prevent the mandrel 1218 from further, downward movement, while the biasing member 1220 may restrain the mandrel 1218 from upward movement. In some embodiments, a locking mechanism may be employed to maintain the mandrel 1218 in the shifted position, e.g., to provide a stable expansion of the actuating dogs 1114.

Figure 20:
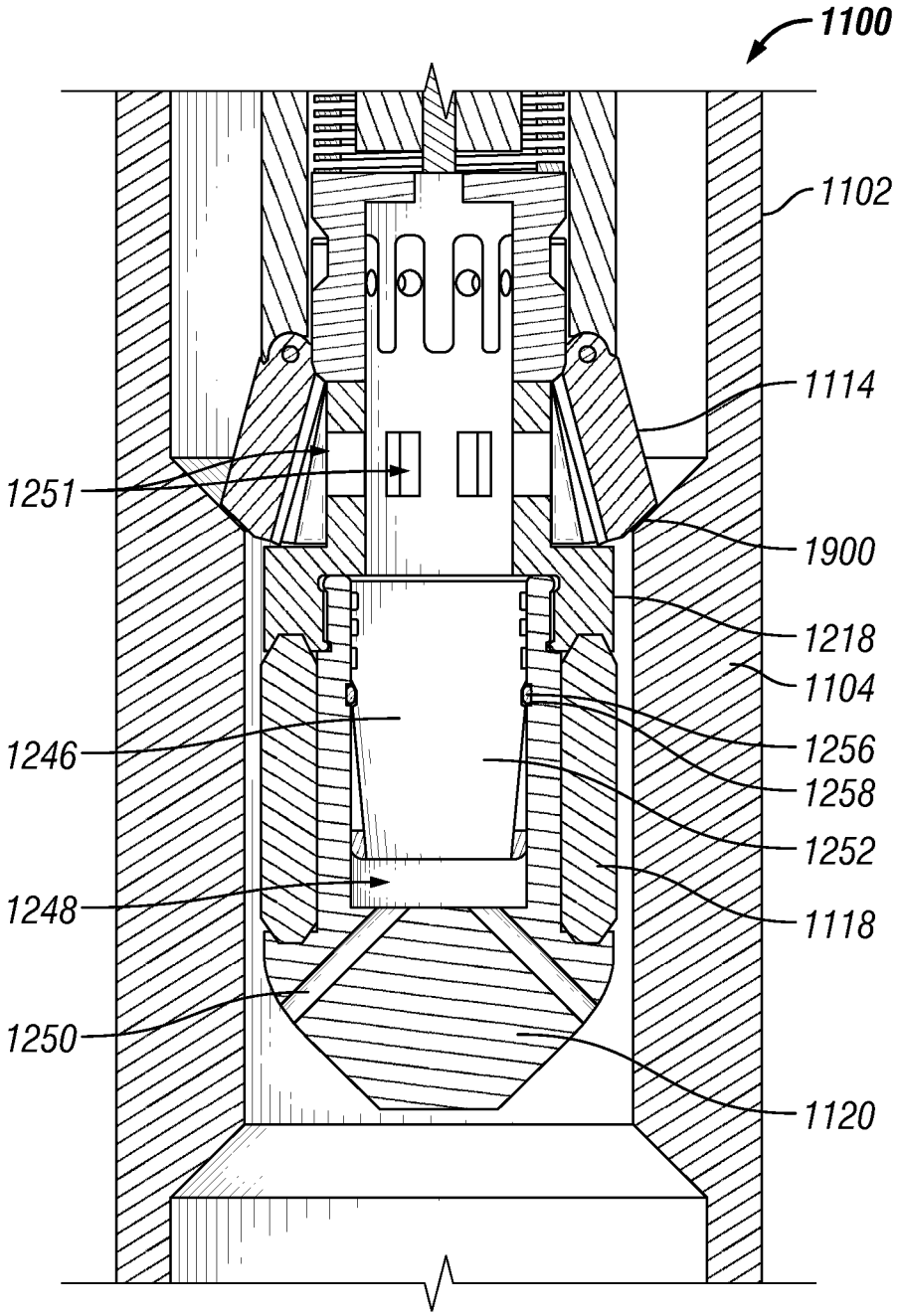
FIG. 20 illustrates a side, cross-sectional view of the plugging device in the expanded configuration landed on a target restriction, according to an embodiment.

With the actuating dogs 1114 deployed radially outward, the plugging device 1100 may continue downward in the conduit 1102. FIG. 20 illustrates a partial, side, cross-sectional view of the plugging device 1100 with the actuating dogs 1114 in the expanded position coming into engagement with the restriction 1104, which may be a target restriction, according to an embodiment. As shown, the actuating dogs 1114 may engage the restriction 1104, thereby preventing the plugging device 1100 from proceeding therethrough.

In some embodiments, the actuating dogs 1114 may optionally include an elastomeric ring or "boot" on the distal end 1900 thereof. The elastomeric ring may expand radially with the actuating dogs 1114, so as to provide at least a partial seal with the restriction 1104. In other embodiments, such a boot may be omitted. Moreover, the distal end 1900 may be tapered or otherwise shaped to provide a large surface area for engagement with the restriction 1104.

Engagement between the actuating dogs 1114 and the restriction 1104 may allow for a pressure differential to be created across the lower assembly 1108. For example, the actuating dogs 1114, although potentially not providing a complete seal, may restrict flow in the conduit 1102 by limiting the flowpath area past the plugging device 1100. Accordingly, a pressure differential may be experienced between the pressure above the actuating dogs 1114 and below the actuating dogs 1114. This pressure may drive the piston 1246 downward, away from the mandrel stop 1116, as the higher pressure above the actuating dogs 1114 may be communicated to one side of the piston 1246 via the ports 1251, while the lower pressure below the actuating dogs 1114 may be communicated to the opposite side of the piston 1246 via the ports 1250. Moreover, the pressure differential may be maintained by the piston 1246 sealing engagement with the dart nose 1120.

Accordingly, the force generated by this pressure differential may overcome the lock ring 1256, expanding the lock ring 1256 outward into the groove 1258 and allowing the piston to move downward into the chamber 1248.

Figure 21:
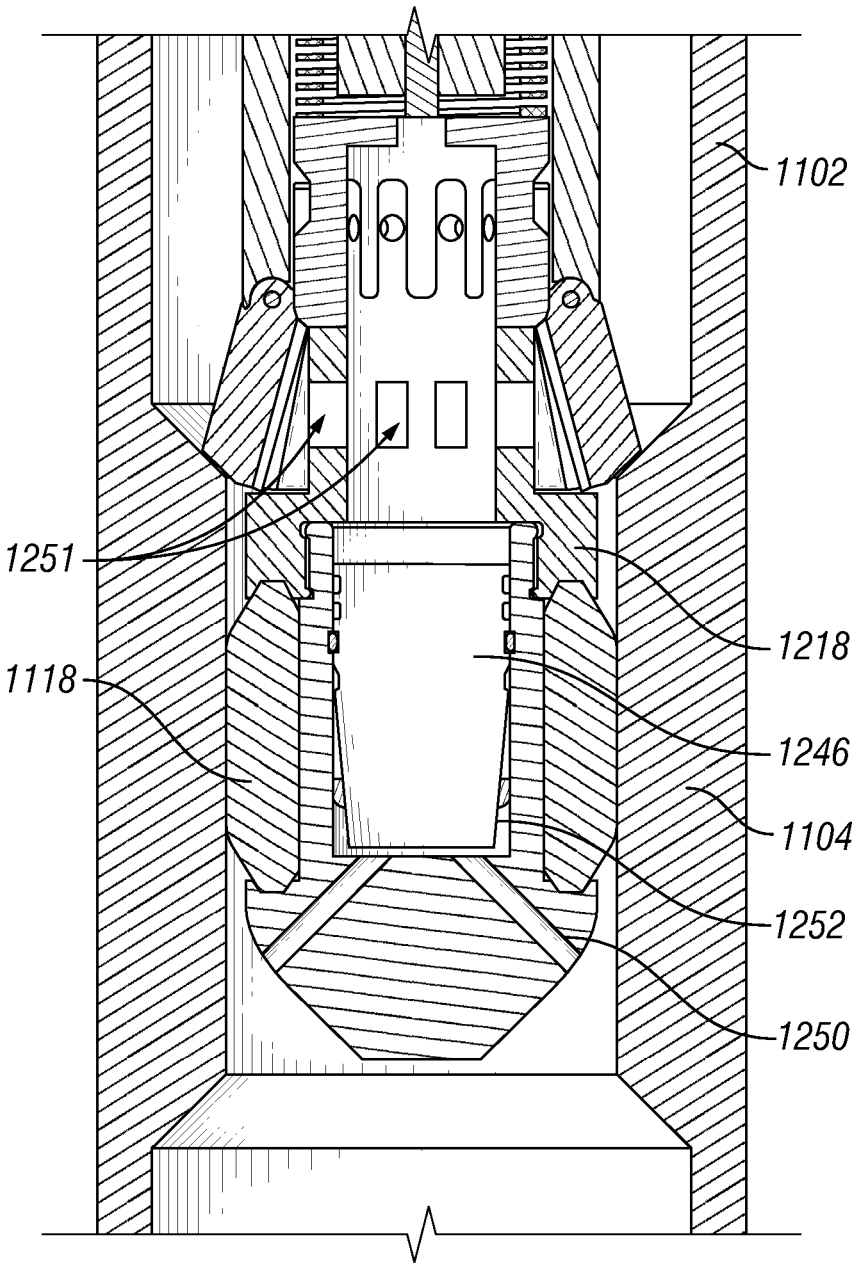
FIG. 21 illustrates a side, cross-sectional view of the plugging device in a set configuration, according to an embodiment.

FIG. 21 illustrates a partial, side, cross-sectional view of the plugging device 1100, according to an embodiment. In particular, in FIG. 21, the plugging device 1100 is shown in a set configuration. As the piston 1246 is driven downwards by the pressure-induced force, the conical section 1252 of the piston 1246 may push the protrusions 1300 of the sealing element 1118, and thus the sealing element 1118 itself, radially outward and into engagement with the restriction 1104, as shown. Further, the sealing element 1118 may form a sealing engagement with the mandrel stop 1116 and the dart nose 1120 on either axial side, and a sealing engagement with the restriction 1104 on the radial outside. Accordingly, the sealing element 1118 may seal the restriction 1104. Additionally, the piston 1246 may be prevented from upward movement, which might allow the sealing element 1118 to retract, by the lock ring 1256, as mentioned above.

Figure 22:
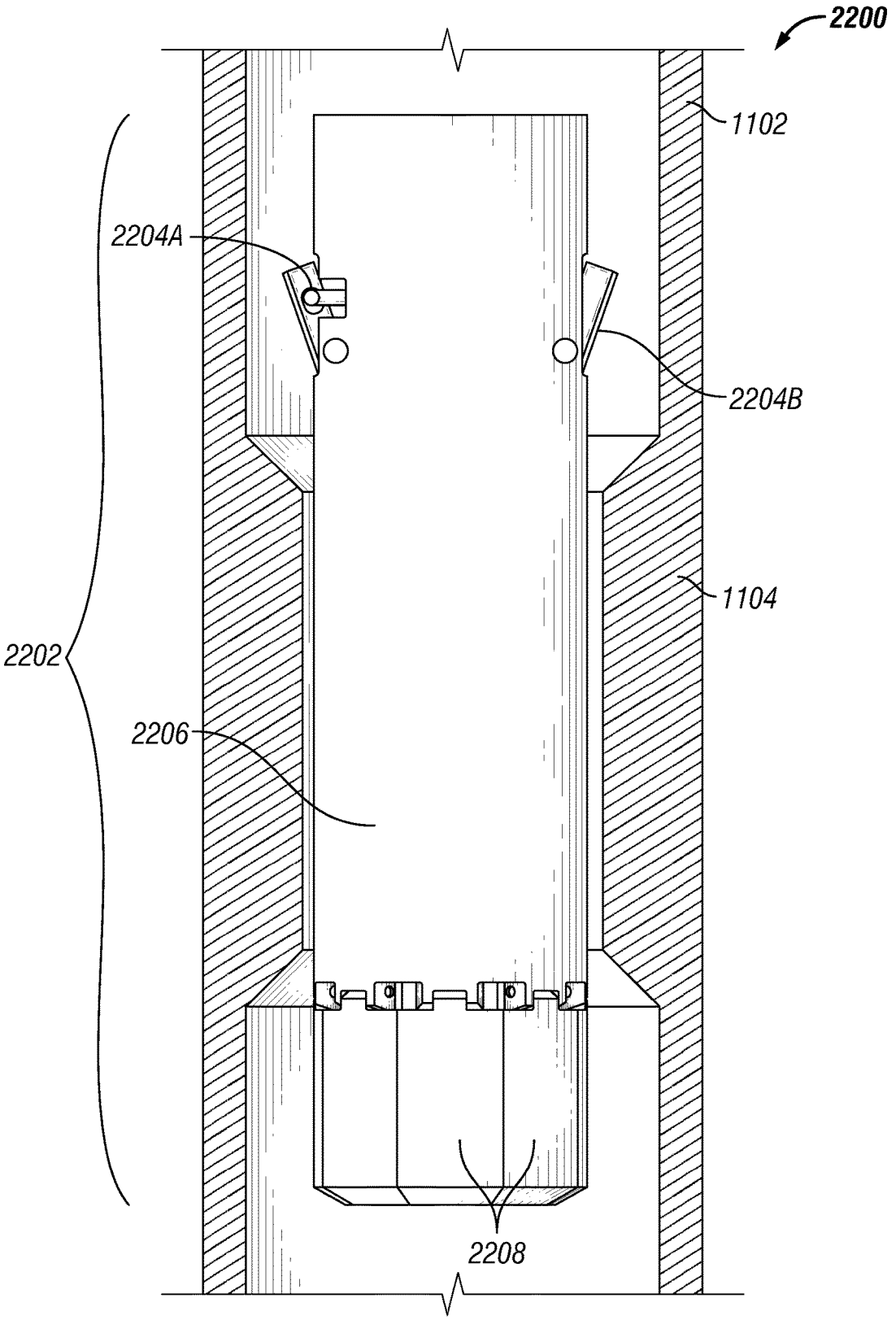
FIG. 22 illustrates a side view of another plugging device in a run-in configuration and positioned in a conduit, according to an embodiment.

FIG. 22 illustrates a partial, side view of another plugging device 2200, according to an embodiment. In particular, an upper assembly 2202 of such a plugging device 2200 is shown, with the lower assembly being substantially similar to the lower assembly 1108 discussed above with respect to the plugging device 1100. In other embodiments, other types of lower assemblies may be employed.

The upper assembly 2202 may include a trigger, such as trigger arms 2204A, 2204B. The upper assembly 2202 may further include a housing 2206, with the trigger arms 2204A, 2204B being pivotally coupled with the housing 2206. The trigger arms 2204A, 2204B may extend outward, so as to engage and be pivoted by interaction with the restriction 1104 of the conduit 1102. The upper assembly 2202 may also include one or more actuating dogs 2208, which may also be pivotally coupled with the housing 2206.

Figure 23:
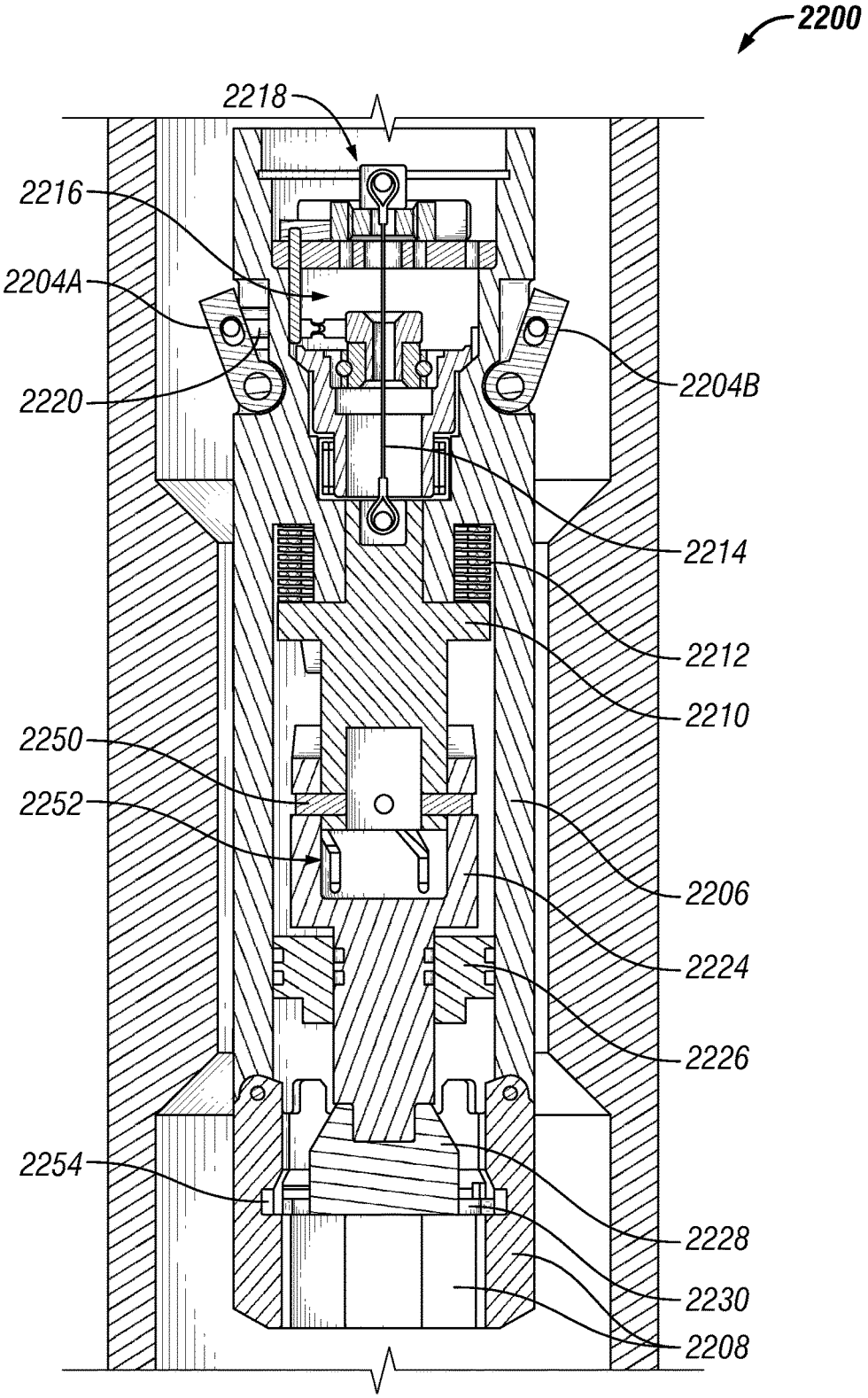
FIG. 23 illustrates a side, cross-sectional view of the plugging device of FIG. 22, in the run-in configuration, according to an embodiment.

FIG. 23 illustrates a side, cross-sectional view of the plugging device 2200, specifically the upper assembly 2202 thereof, according to an embodiment. The upper assembly 2202 may include an actuator, configured to expand the expandable member (e.g., the actuating dogs 2208). The actuator may include a shifting mandrel 2210 disposed within the housing 2206. The shifting mandrel 2210 may be biased downwards, in the illustrated orientation, by a biasing member 2212, e.g., a compression spring disposed between the housing 2206 and the shifting mandrel 2210.

The shifting mandrel 2210 may be restrained from movement by a restraining member 2214. The restraining member 2214 may be any type of structure capable of preventing the shifting mandrel 2210 from moving prematurely, e.g., in response to the force applied by the biasing member 2212. In the illustrated example, the restraining member 2214 is a cable attached to the shifting mandrel 2210. The restraining member 2214 may be coupled on a side opposite to the shifting mandrel 2210 to a section of the housing 2206.

The upper assembly 2202 may also include a counting assembly 2216 and a releasing assembly 2218. The counting assembly 2216 may be similar to the counting assembly 1203, and may operate by the pivotable trigger arms 2204A, 2204B pivoting toward the housing 2206 by engagement with the restrictions 1104. The trigger arms 2204A, 2204B may be coupled with linkages 2220, 2222 which may transmit the movement of the trigger arms 2204A, 2204B to an internal assembly, as will be described in greater detail below. Further, once a predetermined number of trigger arm 2204A, 2204B cycles are completed, the counting assembly 2103 may cause the releasing assembly 2218 to release the shifting mandrel 2210 from the restraining member 2214, e.g., by cutting, detaching, or breaking the restraining member 2214.

In some embodiments, the plugging device 2200 may expand the actuating dogs 2208 using a linearly-moving shifting mandrel, e.g., as discussed above with respect to the mandrel 1218 of the plugging device 1100. In another embodiment, as shown, the plugging device 2200 includes a cam sleeve 2224, a sealing piston 2226, a cam hub 2228, and cams 2230 that pivot to expand the actuating dogs 2208 from the illustrated first, retracted position to a second, expanded position. This operation will be discussed in greater detail below. While these components are shown and described as separated pieces, it will be appreciated that any two or more of the sleeve 2224, piston 2226, hub 2228, and cams 2230 may be formed integrally from a single piece.

The sleeve 2224 and the mandrel 2210 may be coupled together, so as to be slidable and pivotable relative to one anther. For example, the shifting mandrel 2210 may include one or more pins 2250 received into one or more inclined slots 2252 of the cam sleeve 2224. It will be appreciated that the pin 2250 and slot 2252 arrangement is but one among many contemplated; for example, in other embodiments, the shifting mandrel 2210 may provide a helical screw, while the cam sleeve 2224 may provide a nut that is rotated by movement of the mandrel 2210.

In the illustrated embodiment, the shifting mandrel 2210 may be constrained from rotation relative to the housing 2206, while the cam sleeve 2224 may be rotatable with respect thereto. Accordingly, when the shifting mandrel 2210 is released from the restraining member 2214, the biasing member 2212 may cause the shifting mandrel 2210 to move downwards, toward the cam sleeve 2224. The interaction between the pin 2250 and the inclined slot 2252 may convert such downward movement of the shifting mandrel 2210 into rotation of the cam sleeve 2224. This may, in turn, cause the cam hub 2228 to rotate, along with the cams 2230 coupled thereto.

The cams 2230 may engage the actuating dogs 2208. For example, the cams 2230 may be received in grooves 2254 defined in the inside of the actuating dogs 2208. The rotation of the cams 2230, while received in the grooves 2254 may cause the actuating dogs 2208 to expand. In another embodiment, the cams 2230 may extend inwards from the actuating dogs 1114 and engage a camming surface, e.g., provided by the cam hub 2228.

In some embodiments, the actuating dogs 2208 may be constrained from prematurely expanding outwards using, for example, an elastic band or rupture band disposed around or within the actuating dogs 2208, to hold the actuating dogs 2208 in the unexpanded state until actuating dogs 2208 are forced outwards by action of the cams 2230.

Figure 24:
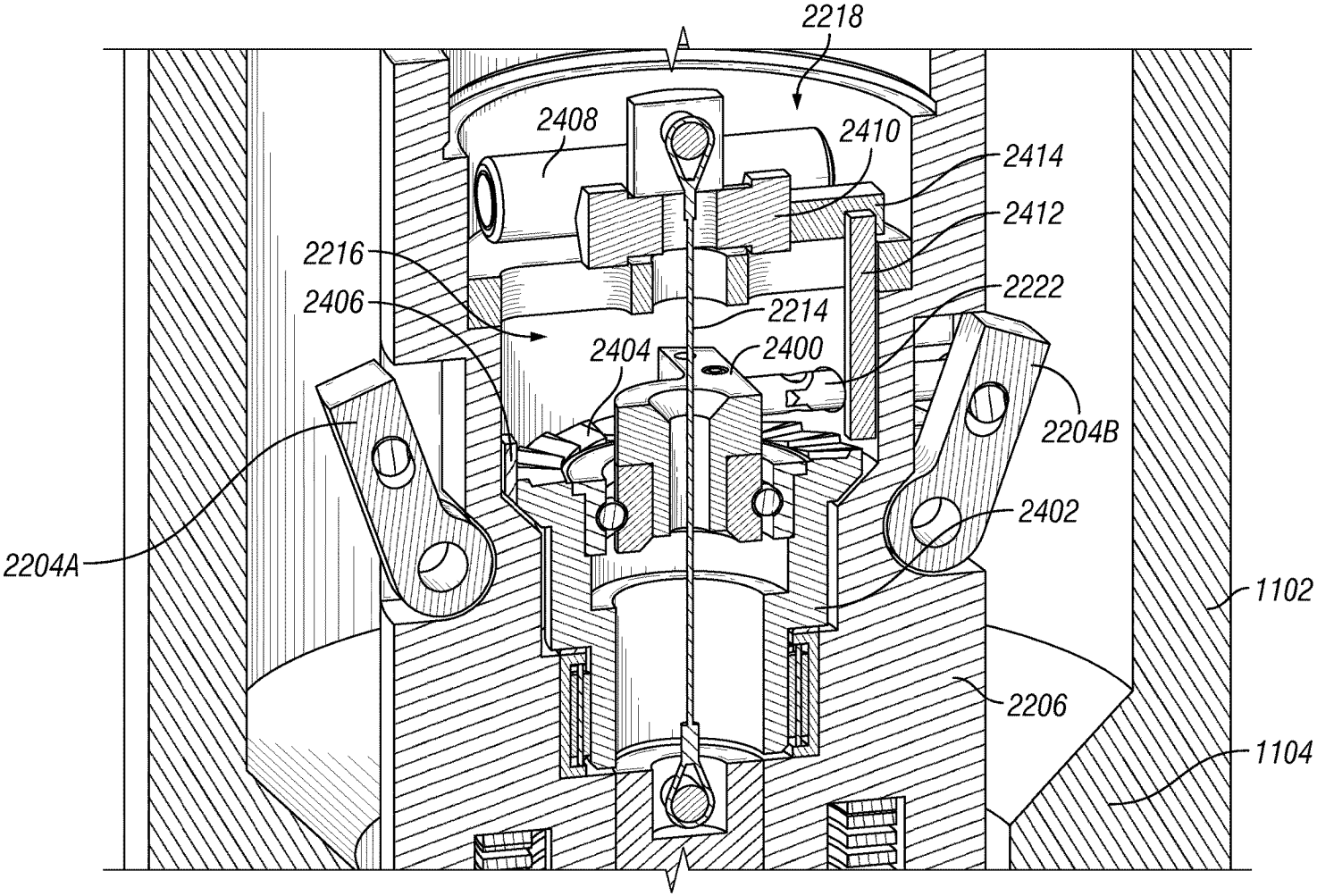
FIG. 24 illustrates an enlarged, cross-sectional view of the plugging device of FIG. 22, showing the counting assembly thereof, according to an embodiment.

FIG. 24 illustrates a partial, sectional view of the upper assembly 2202 of the plugging device 2200, according to an embodiment. As noted above, the counting assembly 2216 may be similar to the counting assembly 1203 discussed above. Thus, in this embodiment, the counting assembly 2216 may include an pawl arm 2400 connected to the trigger arms 2204A, 2204B via the linkages 2220, 2222 (2220 is not visible in this section view). The counting assembly 2216 may further include a ratchet cylinder 2402 with teeth 2404 that interact with the pawl arm 2400 so as to rotate the ratchet cylinder 2402 in response to the trigger arms 2204A, 2204B pivoting.

The counting assembly 2216 may also include an electrical contact 2406 coupled with the ratchet cylinder 2402 so as to move therewith. Further, the cutting assembly 2218 may include a power source 2408, such as a battery (as shown), a capacitor, or another device that may provide an electrical current. The power source 2408 may be electrically coupled with the contact 2406. The power source 2408 may also be connected with a releasing member 2410 of the releasing assembly 2218. The releasing member 2410 may be configured to release the restraining member 2214 upon becoming part of a completed circuit with the power source 2408. In the illustrated example, the releasing member 2410 may be a cable cutter. For example, the releasing member 2410 may include an explosive charge configured to cause a cutting element to sever the cable of the restraining member 2214. In other embodiments, any other suitable structure able to release the releasing member 2214, e.g., by rotation of a hook, removal of a pin, breaking of a frangible member, transitioning a shape memory alloy, melting a releasing member 2214, etc., may be employed.

The releasing assembly 2216 may also include a conductor 2412, which may extend from a position proximal to the ratchet cylinder 2402, and may be in electrical communication with the releasing member 2410, e.g., via one or more electrical components 2414. The conductor 2412 may be positioned to make contact with the electrical contact 2406, without interfering with the operation of the ratchet cylinder 2402. Similarly, the electrical contact 2406 may be sized and/or positioned so as to avoid interfering with the ratchet cylinder 2402, e.g., so as to pass by the linkages 2220, 2222.

In operation, as the trigger arms 2204A, 2204B cycle, the ratchet cylinder 2402 rotates relative to the housing 2206. The contact 2406 may rotate along with the ratchet cylinder 2402 until the contact 2406 touches the conductor 2412. When that occurs, a circuit including the power source 2408 and the releasing member 2410 is completed, and the releasing member 2410 releases the restraining member 2214.

Figure 25A:
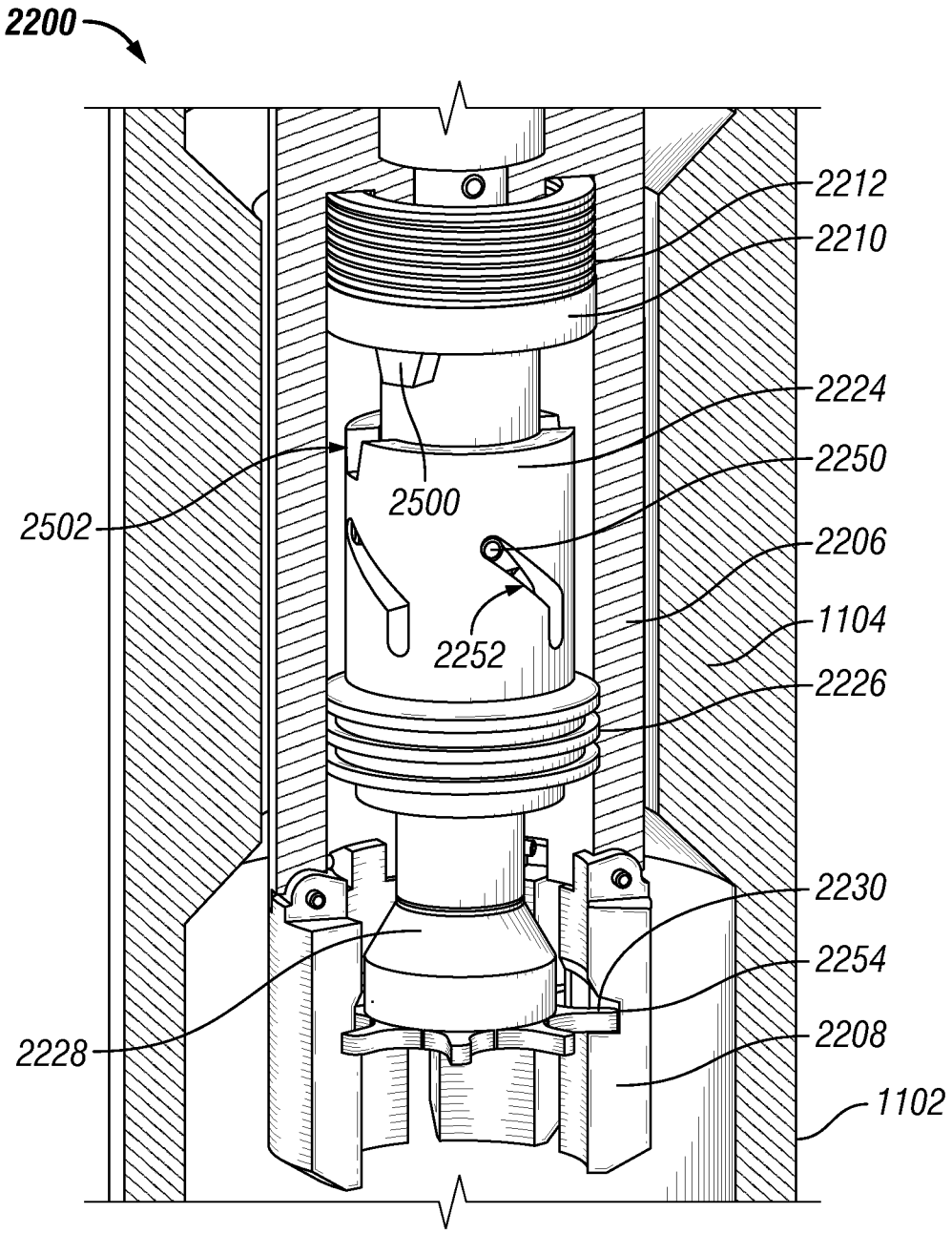
FIGS. 25A-25C illustrate side, cross-sectional views of the plugging device of FIG. 22, showing actuation of the plugging device from the run-in configuration to the expanded configuration, according to an embodiment.
Figure 25C:
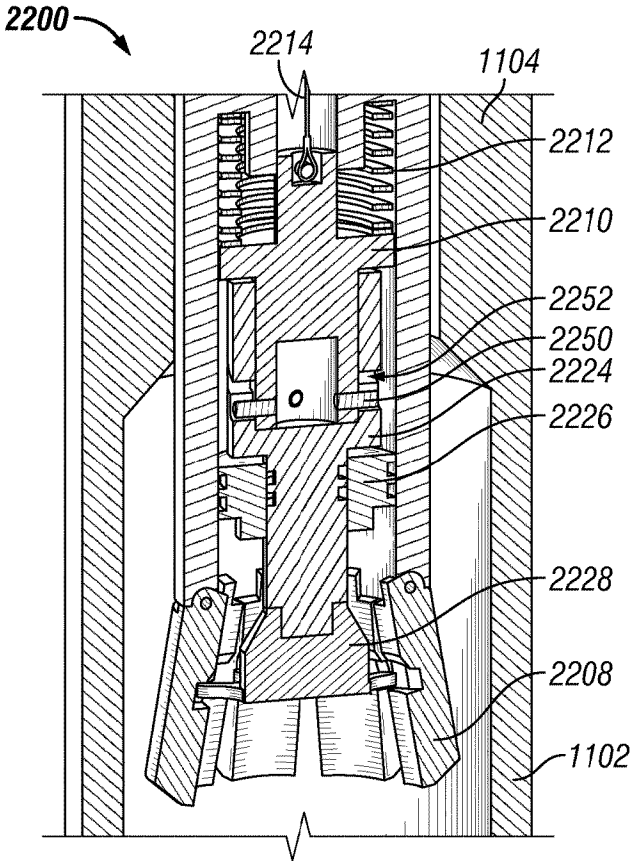
Figure 25B:
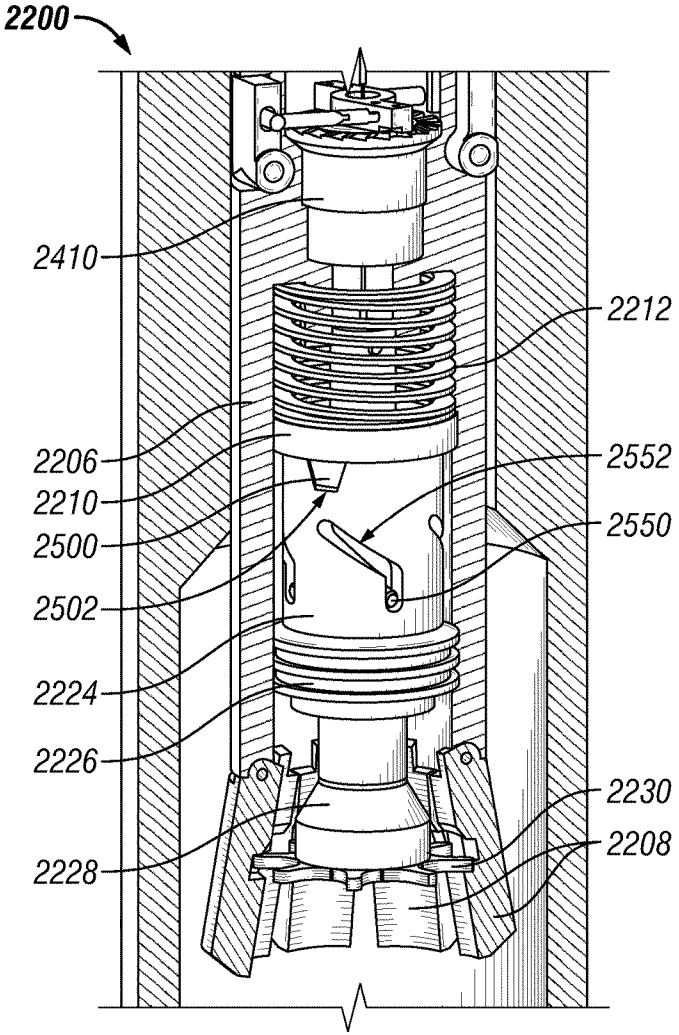

FIGS. 25A-25C illustrate partial perspective views of the plugging device 2200, showing the actuation of the plugging device 2200 from the run-in configuration, in which the actuating dogs 2208 are collapsed, to the expanded configuration, in which the actuating dogs 2208 are expanded, according to an embodiment.

In particular, FIG. 25A shows the plugging device 2200 prior to actuation, e.g., in the run-in configuration. As shown, the actuating dogs 2208 are collapsed, for example, to less than or about equal to the same outer diameter as the housing 2206, allowing the plugging device 2200 to pass through the restriction 1104 in the conduit 1102. Further, the biasing member 2212 may be in a compressed state (or otherwise may contain potential energy that may be employed to move the shifting mandrel 2210), with the shifting mandrel 2210 restrained by the restraining member 2214 (see, e.g., FIG. 22). The pins 2250 of the shifting mandrel 2210 are received in the inclined slots 2252 of the cam sleeve 2224, while the piston 2226 may seal the interior of the housing 2206 containing the shifting mandrel 2210 from the exterior of the plugging device 2200.

Also visible in FIG. 25A is a lug 2500 formed on or otherwise coupled with the shifting mandrel 2210. The lug 2500 may be received into a lug slot 2502 formed in the cam sleeve 2224. When the lug 2500 is received into the lug slot 2502, e.g., when the plugging device 2200 is in the expanded configuration, the cam sleeve 2224 may be prevented from rotating relative to the shifting mandrel 2210, while the shifting mandrel 2210 may be prevented from rotating relative to the housing 2206.

FIGS. 25B and 25C show the plugging device 2200 after actuation, in an expanded configuration, e.g., after passing through a predetermined number of restrictions 1104. As shown, the actuating dogs 2208 are expanded to their second, expanded position, such that the actuating dogs 2208 may prevent the plugging device 2200 from passing through another restriction 1104.

After the counting assembly 2216 (e.g., FIGS. 23 and 24) counts the predetermined number of cycles, the releasing assembly 2218 may respond by releasing the restraining member 2214, e.g., cutting the cable. This may allow the biasing member 2212 to push the shifting mandrel 2210 downwards as the biasing member 2212 expands, as shown. The shifting mandrel 2210 moving downwards may cause the pin 2250 thereof to move in the inclined slot 2252, which, in turn, causes the cam sleeve 2224 to rotate as the shifting mandrel 2210 is advanced. This rotation is transmitted via the cam sleeve 2224 and the cam hub 2228 to the cams 2230. The cams 2230 and the actuating dogs 2208 are shaped to translate the rotation of the cams 2230 into expansion of the actuating dogs 2208.

Although not illustrated, a lower assembly (e.g., including a dart nose, sealing element, piston, etc.) may be coupled with the cam hub 2228. In an embodiment, such coupling may employ a bearing, so as to allow the cam hub 2228 to rotate, while the dart nose may stay generally stationary.

Figure 26B:
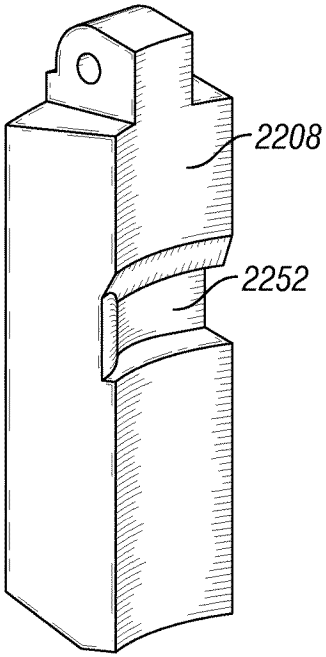
FIG. 26B illustrates a perspective view of an actuating dog, according to an embodiment.
Figure 26C:
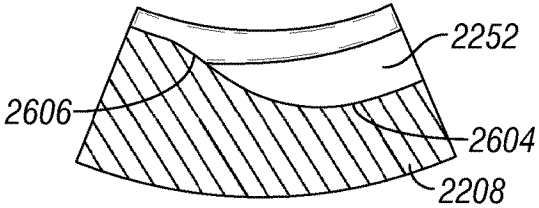
FIG. 26C illustrates a cross-sectional view of the actuating dog of FIG. 26B, according to an embodiment.
Figure 26A:
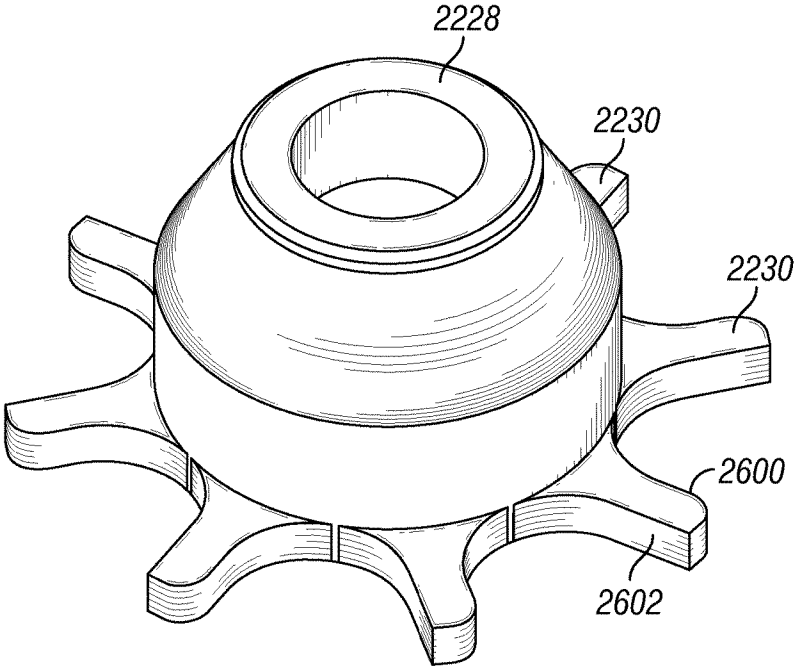
FIG. 26A illustrates a perspective view of a cam hub and cams, according to an embodiment.

FIGS. 26A-C show more-detailed views of an embodiment of the cam hub 2228 with the cams 2230, and two views of an example of one of the actuating dogs 2208. As shown in FIG. 26A, each cam 2230 may be formed as an extension from the cam hub 2228. Further, the cams 2230 may each include a rounded engaging side 2600 and a backside 2602. As mentioned above and shown in FIG. 26B, according to an embodiment, the actuating dogs 2208 may include the groove 2254 on the inner surface thereof. FIG. 26C illustrates a cross-section of the groove 2254, according to an embodiment. As shown, the groove 2254 may not have a uniform depth, but may become shallower in one circumferential direction. For example, the illustrated groove 2252 has a deeper section 2604 that transitions to a shallower section 2606. When the cam 2230 engages the deeper section 2604, the actuating dogs 2208 may be in the unexpanded state, and when the cam 2230 is rotated, such that it slides into engagement with the shallower section 2606, the actuating dogs 2208 may be in the expanded state.

Figure 27:
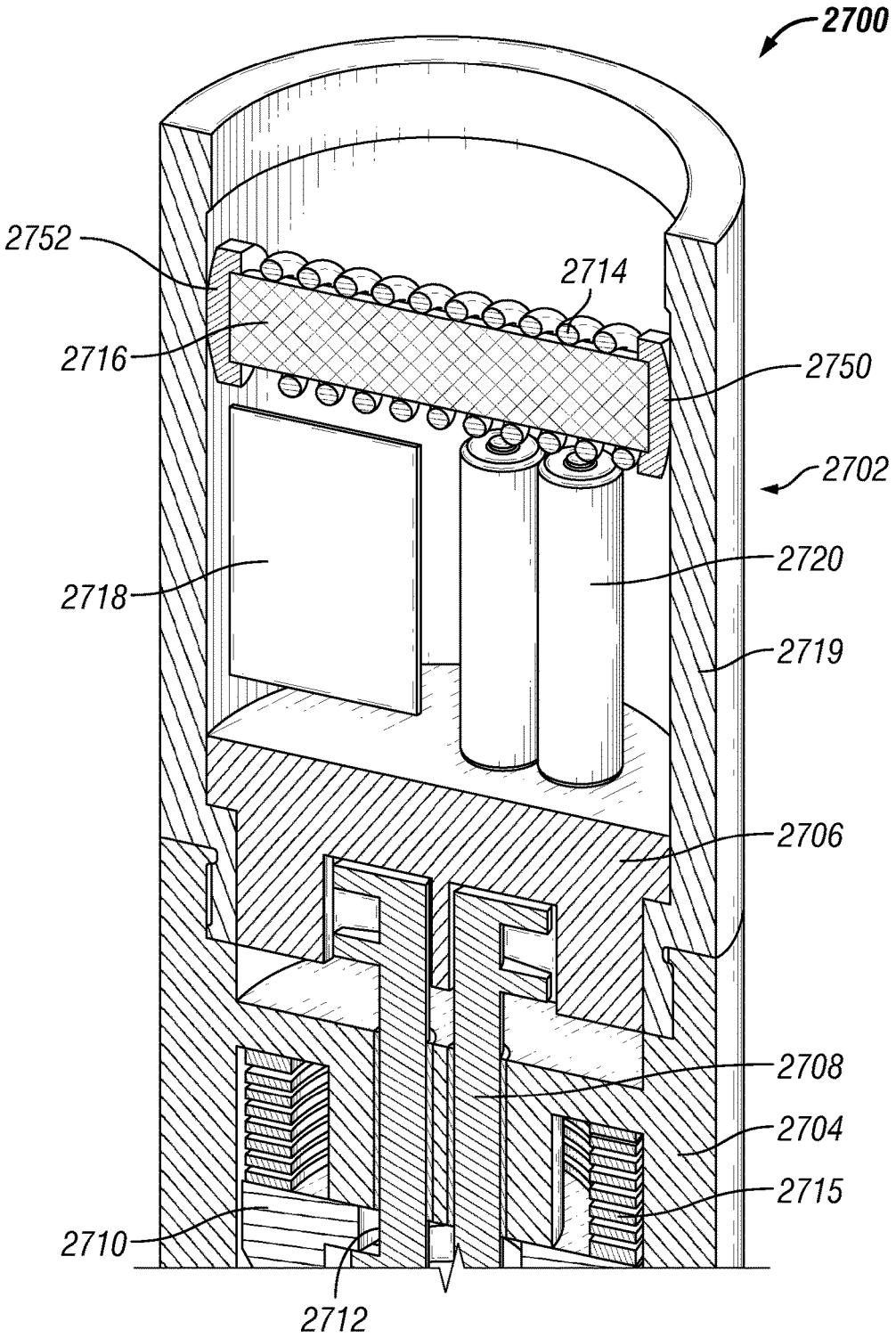
FIG. 27 illustrates a cross-sectional view of yet another plugging device, according to an embodiment.

FIG. 27 illustrates a perspective view of a section of another plugging device 2700, according to an embodiment. The plugging device 2700 may include actuating dogs and an expandable sealing element, as described above with respect to the preceding embodiments. To expand the dogs and/or expandable members, the plugging device 2700 may include a counting assembly 2702 which may be coupled with a housing 2704.

The counting assembly 2702 may include an actuating mechanism 2706, such as an electric motor, as shown, but in other examples, the releasing mechanism may be configured to break or otherwise release a restraining member. In the illustrated example, the actuating mechanism 2706 may be coupled with a pivot shaft 2708, which may be received into a mandrel 2710, e.g., with a key head 2712 of the pivot shaft 2708 retaining the pivot shaft 2708 partially in the mandrel 2710 until rotated to a particular rotational position, e.g., by operation of the actuating mechanism 2706. When the pivot shaft 2708 is released from the mandrel 2710, in this embodiment, a biasing member 2715 (e.g., compression spring) may push the mandrel 2710 downwards, so as to expand actuating dogs, as explained, for example, above. In another embodiment, the pivot shaft 2708 may be threaded, and the mandrel 2710 may also be threaded, such that the mandrel 2710 may be driven downwards by rotation of the pivot shaft 2708.

The counting assembly 2702 may employ electromagnetism to count the number of restrictions that the plugging device 2702 has passed through, prior to expanding the actuating dogs. For example, the counting assembly 2702 may include a conductive wire coil 2714 wrapped around a magnet 2716, with poles disposed at either end. Further, a housing 2719 of the counting assembly 2702, which may be coupled with the housing 2704, may be constructed from a non-ferrous and/or magnetically permeable material, such as a fiber-reinforced carbon or glass, plastic, or the like, for example.

The coil 2714 may be coupled with a circuit board 2718, which may in turn be coupled with a power source 2720, such as one or more batteries (as shown), capacitors, or any other suitable power source. The circuit board 2718 may include a logic device, such as a processor or another electronic device capable of counting pulses of current. The power source 2720 may be coupled with the actuating mechanism 2706, so as to provide power thereto at the selection of the circuit board 2718. In some embodiments, the magnet 2716 and wire coil 2714 may independently generate a current, and the power source may be omitted.

The plugging device 2700 may also include endcaps 2750, 2752 on the magnet 2716. The endcaps 2750, 2752 may provide a high-permeability flux path between the magnet 2716 and the outer diameter of the housing 2719. The endcaps 2750, 2752 may be sized to conform to shape of the housing 2719.

In a specific embodiment, the magnet 2716 may be a permanent magnet (such as samarium cobalt, neodymium iron boron) or magnet array that may create a magnetic flux circuit that extends outside of the housing 2719. Magnetic field lines and thus magnetic flux may return from the north to the south pole of the magnet 2716.

The housing 2719 may be made of low permeability material to minimize magnetic flux returned through the housing 2719. High permeability metals used in the restriction 1104 may provide a flux return path for the magnetic field. The magnetic flux may pass from the north pole of the magnet 2716 radially outward into the restriction 1104, and may then travel circumferentially around the ball seat, and then radially inward to the south pole of the magnet, in a symmetric pattern. In contrast, the large radial gap between the conduit 1102 and the plugging device 2700 may provide a relatively poor magnetic flux return path. With the poor magnetic flux path, the total magnetic flux may be low. With the strong magnetic flux path created by the restriction 1104, the total magnetic flux will be high.

The coil 2714 wrapped around the magnet 2716 may be sensitive to the change in flux passing through the coil. As the plugging device 2700 passes from a low flux to a high flux condition, the coil 2714 may generate an electrical current proportional to the change in flux per unit time.

In another embodiment, a magnetic field sensor, such as a magnetometer or giant magnetoresistive sensor, may be positioned within the housing 2719 to measure the magnetic field strength in a given direction. The change in the magnetic flux return path in the low flux and high flux conditions may result in a change in the magnetic field lines passing the sensor, and a change in the magnetic field strength measured by the sensor. The coil 2714 or the magnetic field sensor may thus provide an indicator of passage through a restriction 1104 that can be used to increment the counter.

In general, in operation, when the plugging device 2700 passes through a restriction, the magnetic field generated by the magnet 2716 may be affected, causing a current in the coil 2714. The circuit board 2718 and/or one or more current measuring devices coupled therewith, may recognize the current, and the circuit board 2718 may increment the count of the number of restrictions that the plugging device 2700 has passed through. When the number of restrictions equals a predetermined number, the circuit board 2718 may cause the power source 2720 to supply power to the actuation mechanism 2706, such that, in this case, the actuation mechanism 2706 rotates the pivot shaft 2708, e.g., until the mandrel 2710 is released.

Accordingly, it will be appreciated that embodiments of the present disclosure may provide a plugging device with several functional modules that allow the plugging device to count the number of restrictions (e.g., ball seats) through which the plugging device has passed and expand to engage and, e.g., seal with a target restriction. In an embodiment, the plugging device may include a trigger module, a counting module, an actuation module, and an expandable module. The plugging device may be formed by selecting one or more trigger modules, one or more counting modules, one or more actuation modules, and one or more expandable modules. The selection of the modules may be dependent at least partially on the wellbore environment. Thus, the various different modules may be used with any of the other different types of modules to form the plugging device, e.g., depending on the wellbore environment, among other potential factors.

The trigger module may be or include any device or devices that change state when the plugging device passes through a restriction. This may include pivoting trigger arms, a magnetic flux sensor, optical sensors, and/or RFID tags/readers. The trigger module may also or instead react to differential pressure across the plugging device. For example, as a plugging device passes through a restriction, a reduction of the flow around the plugging device may be experienced. A piston may be balanced in the plugging device to respond to that pressure differential, and the displacement can increment a counter. Another type of trigger module may react to inertial contact of the plugging device on the restriction. The plugging device may cause an impact or contact as it approaches the restrictions. This impact may cause a spring-mounted mass to displace, thus incrementing a counter. Still another trigger module may be magnetic. Passage of the plugging device through the restriction may bring magnetic steel of the restriction into close proximity with the plugging device. Permanent magnets located in the plugging device may be attracted to the restriction. Thus, deflection (or displacement) of the magnets, mounted on springs, may increment the counter. Further, embodiments of the plugging device may employ two or more types of triggers to prevent false triggers, as also mentioned above.

The counting module may also take several forms, including the ratcheting and/or electrical logic devices discussed above. In addition, the counting module may include a hydraulic volume. The trigger input may cause a discrete increment of fluid to be pushed into a chamber, causing a piston to travel a fixed displacement. Once a predetermined volume of fluid has been injected by multiple triggers, the piston would displace to an open a flow port or otherwise cause an action. The counting module may also or instead include a screw. For example, a torsion spring may turn a screw through a fixed angle for each trigger input. In response, a nut travelling on the screw may displace along the screw. Once a preset position is reached, an action would be caused.

The counting module may also include a linear ratchet. The ratchet may push a pin with a repeated conical wedge feature (e.g., analogous to a screw without the helix but with repeated rings) through a spring-loaded nut that allows one-way travel. With each trigger input, the pin pushes forward through one increment of displacement relative to the nut. When a preset displacement has been reached, an action is induced. The counting module might also or instead include a piezoelectric element. The trigger arm may cause a compression in a piezoelectric material, creating an electrical charge. The charge may be used to charge up a capacitor. With each increment of added charge, the voltage on the capacitor may increase. When a set voltage is reached, an action may be induced. Additionally or instead of such capacitor, an electrical counter may count the electrical pulses from the piezoelectric.

The actuation module may be or include a biasing member, pivoting shaft, restraining member, rotary device, or the like, as discussed above. The actuation module may thus rely on stored energy to quickly release and expand the expandable module. The stored energy may be provided by battery or capacitor, chemical energy (e.g., thermite heat generator, gas generator, such as an air bag or propellant, two-part chemistry mix to create dissolving agent, etc.), a mechanical or hydraulic spring, or a shape-memory alloy.

In releasing the stored energy, the actuation module may employ shear pin failure, rupture disk failure, melting or phase change (low melting point alloy), fracture of a metal element (frangibles), and/or translation or rotation to create feature alignment. Thus, actuation may occur in various forms such as generating heat to pressurize a fluid, melt a solid, contract an SMA, and/or thermally expand or deflect a material. Another example of actuation module may be providing electrical energy to create heat, initiate a gas generator, energize a solenoid or motor, and/or actuate a piezoelectric material. Yet another example of actuation may be using chemical energy to generate heat to expand a fluid, create pressure, and/or to destroy a mechanical linkage. Further, a spring may be released to generate a force, create stress, and/or apply pressure. Moreover, an amplification feature may be provided, such as levers, jacks, hydraulics, pneumatics, etc., to apply a greater force on the expandable module.

The expandable module may be actuating dogs, as discussed above, shoulders, lugs, elastic materials, slips, etc., so as to allow engagement with the restriction and plugging of the conduit.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A plugging device, comprising:

an expandable member configured to move from a first, retracted position to a second, expanded position;

a counter configured to count a number of restrictions in a conduit that the plugging device passes through;

an actuator configured to move the expandable member from the first position to the second position in response to the counter counting a predetermined number of restrictions, wherein the expandable member in the expanded position prevents the plugging device from passing through a target restriction; and a sealing element, wherein the sealing element expands after the expandable member is expanded to the second, expanded position.

2. The plugging device of claim 1, further comprising a housing, wherein the expandable member comprises a plurality of actuating dogs that are pivotally coupled with the housing, the plurality of actuating dogs being pivotal outward from the housing from the first position to the second position, wherein the plurality of actuating dogs are configured to engage the target restriction when expanded into the second position.

3. The plugging device of claim 1, further comprising a trigger, wherein the trigger reacts each time the plugging device passes through one of the restrictions, the counter being configured to count a number of reactions of the trigger.

4. The plugging device of claim 3, further comprising a housing, wherein the trigger comprises a trigger arm that is pivotally coupled with the housing, and wherein the trigger arm is configured to pivot inward, toward the housing, when the plugging device passes through one of the restrictions.

5. The plugging device of claim 4, wherein the counter comprises:

an pawl arm comprising a pawl;

a ratchet comprising teeth, wherein the pawl of the pawl arm engages the teeth; and a linkage coupled with the trigger arm and the pawl arm, such that the trigger arm pivoting causes the pawl arm to rotate.

6. The plugging device of claim 5, wherein the actuator comprises:

a biasing member;

a mandrel that is biased by the biasing member; and a restraining member that prevents the mandrel from moving under force of the biasing member until the counter counts the predetermined number of times.

7. The plugging device of claim 6, wherein the restraining member comprises a pivot shaft having a key head received through a keyhole of the mandrel, the keyhole comprising a slot, wherein the pivot shaft restrains the mandrel from moving until the pivot shaft is rotated into alignment with the slot of the keyhole.

8. The plugging device of claim 6, wherein, when the counter counts the predetermined number of times, the restraining member releases from the mandrel, and the biasing member forces the mandrel to move and expand the expandable member.

9. The plugging device of claim 6, wherein:

the restraining member comprises a cable;

the actuator comprises a cable cutter, a power source, and an electrical conductor coupled with the power source and the cable cutter;

the counter comprises an electrical contact electrically coupled with the power source, wherein the electrical contact moves when the ratchet rotates; and when the counter counts the predetermined number of times, the electrical contact engages the electrical conductor, causing the cable cutter to cut the cable, which allows the biasing member to move the mandrel and expand the expandable member.

10. The plugging device of claim 6, wherein the actuator further comprises a cam sleeve rotatably and slidably coupled with the mandrel, wherein, when the restraining member is released, the biasing member forces the mandrel to move toward the cam sleeve, and wherein the mandrel moving causes the cam sleeve to rotate.

11. The plugging device of claim 10, wherein the actuator comprises a cam coupled with the cam sleeve and engaging the expandable member, and wherein, when the cam sleeve rotates, the cam sleeve moves with respect to the expandable member and forces the expandable member to expand toward the second position.

12. The plugging device of claim 1, further comprising a magnetic sensor configured to generate a current when a magnetic field is changed, and wherein the counter counts a number of times the current is generated.

13. The plugging device of claim 1, further comprising:

a dart nose, wherein the sealing element is positioned at least partially around the dart nose; and a piston positioned within the dart nose, wherein the piston is configured to move in response to a pressure differential across the plugging device, and to expand the sealing element.

14. The plugging device of claim 1, wherein:

the expandable member collapses inward by engagement with the restriction; and the counter counts each time the expandable member collapses inward by engagement with the restriction.

15. The plugging device of claim 1, wherein the expandable member, when in the second position and in engagement with the target restriction, forms at least a partial seal with the target restriction.

16. A plugging device, comprising:

an expandable member configured to move from a first, retracted position to a second, expanded position;

a counter configured to count a number of restrictions in a conduit that the plugging device passes through; and an actuator configured to move the expandable member from the first position to the second position in response to the counter counting a predetermined number of restrictions, wherein the expandable member in the expanded position prevents the plugging device from passing through a target restriction, wherein the actuator comprises:

a mandrel that is configured to expand the expandable member;

a shaft coupled with the mandrel; and a rotating actuator coupled with the shaft and configured to rotate the shaft, wherein the shaft rotating causes the mandrel to move and expand the expandable member.

17. An apparatus for restricting flow through a conduit, the apparatus comprising:

a plugging device configured to be dropped into the conduit, the plugging device comprising:

an expandable member configured to move from a first, retracted position to a second, expanded position;

a counter for counting a number of restrictions through which the plugging device proceeds in the conduit;

an actuator configured to move the expandable member from the first position to the second position in response to the counter counting a predetermined number of restrictions, wherein the expandable member in the expanded position prevents the plugging device from passing through a target restriction, wherein the actuator comprises:

a biasing member;

a mandrel that is biased by the biasing member; and a restraining member that prevents the mandrel from moving under force of the biasing member until the counter counts the predetermined number of times, wherein the restraining member comprises a pivot shaft having a key head received through a keyhole of the mandrel, the keyhole comprising a slot, wherein the pivot shaft restrains the mandrel from moving until the pivot shaft is rotated into alignment with the slot of the keyhole; and a valve defining a plug seat to be disposed within the conduit to catch the plugging device when the number of restrictions counted by the counter meets or exceeds a predetermined number.

18. The apparatus of claim 17, wherein a plurality of plugging devices of a single plug element size are used to actuate multiple valves in the conduit.

19. The apparatus of claim 17, wherein the counter comprises a part of the plugging device.

20. The apparatus of claim 19, wherein the counter is actuated by an inwardly collapsing structure of the plugging device as the plugging device passes through other restrictions in the conduit.

21. The apparatus of claim 17, wherein the counter includes a trigger arm that extends outwardly, the trigger arm being movable to advance the counter.

22. A method for restricting flow in a wellbore, comprising:

deploying a plugging device into a conduit comprising a plurality of restrictions, the plurality of restrictions comprising a target restriction and at least one other restriction, wherein, when deployed, the plugging device encounters the at least one other restriction prior to the target restriction, and wherein the at least one other restriction has a restriction diameter of a same or smaller size as a restriction diameter of the target restriction, the plugging device comprising:

an expandable member configured to expand from a first, retracted position to a second, expanded position;

a counter configured to count a number of restrictions that the plugging device passes through; and an actuator configured to expand the expandable member from the first position to the second position in response to the counter counting a predetermined number of restrictions, wherein the expandable member in the expanded position prevents the plugging device from passing through the target restriction, wherein the actuator comprises:

a biasing member;

a mandrel that is biased by the biasing member; and a restraining member that prevents the mandrel from moving under force of the biasing member until the counter counts the predetermined number of times wherein, when the counter counts the predetermined number of times, the restraining member releases from the mandrel, and the biasing member forces the mandrel to move and expand the expandable member.

* * * * *